US009091089B2

(12) United States Patent
Pfeiffer

(10) Patent No.: US 9,091,089 B2
(45) Date of Patent: Jul. 28, 2015

(54) INSULATING CONCRETE FORM (ICF) SYSTEM WITH TIE MEMBER MODULARITY

(71) Applicant: Henry E. Pfeiffer, Omaha, NE (US)

(72) Inventor: Henry E. Pfeiffer, Omaha, NE (US)

(73) Assignee: ICF MFORM LLC, Omaha, NE (US)

( * ) Notice: Subject to any disclaimer, the term of this patent is extended or adjusted under 35 U.S.C. 154(b) by 0 days.

(21) Appl. No.: 13/796,034

(22) Filed: Mar. 12, 2013

(65) Prior Publication Data

US 2014/0260055 A1 Sep. 18, 2014

(51) Int. Cl.

| | |
|---|---|
| ***E04B 2/00*** | (2006.01) |
| ***E04G 17/12*** | (2006.01) |
| ***E04G 11/08*** | (2006.01) |

(52) U.S. Cl.

CPC ..... *E04G 17/12* (2013.01); *E04G 11/087* (2013.01)

(58) Field of Classification Search

CPC ..... E04G 17/12; E04G 11/087
USPC ..... 52/582.1, 426, 429, 562
See application file for complete search history.

(56) References Cited

U.S. PATENT DOCUMENTS

| | | | |
|---|---|---|---|
| 1,096,267 | A | 5/1914 | Sammis |
| 1,345,156 | A | 5/1920 | Flynn |
| 1,578,511 | A | 3/1926 | Gladwin |
| 1,732,056 | A | 10/1929 | Lesher |
| 2,316,819 | A | 10/1940 | Tedrow |
| 2,594,378 | A | 7/1947 | Baldanza |
| 2,864,150 | A | 12/1958 | Henderson |
| 3,321,884 | A | 5/1967 | Klaue |
| 3,611,664 | A | 10/1971 | Barbera |
| 3,625,470 | A | 12/1971 | Shoemaker |
| 3,782,049 | A | 1/1974 | Sachs |
| 3,848,843 | A | 11/1974 | Levy |
| 3,964,226 | A | 6/1976 | Hala et al. |
| 4,055,321 | A | 10/1977 | Schimmel |

(Continued)

OTHER PUBLICATIONS

International Search Report and Written Opinion for PCT/US14/11143.

(Continued)

*Primary Examiner* — Basil Katcheves
(74) *Attorney, Agent, or Firm* — Husch Blackwell LLP; Samuel Digirolamo

(57) ABSTRACT

A modular tie member which promotes flexibility in manufacturing ICF blocks of varying widths and heights, one embodiment including a pair of side wall bracket members each encapsulated within a respective panel member forming an ICF block and a web member pivotally attached to and extending between the side wall bracket members. Each bracket member may include an extension portion and/or another interlocking mechanism associated with each opposite end thereof positioned for overlapping and engaging similar members associated with similarly constructed tie members when one tie member is stackably arranged one on top of another tie member. The extension portions and/or the other interlocking mechanism extend into respective teeth associated with the horizontally opposed edges of the panel members for mating with the extension portions and/or the other interlocking mechanism of another tie member associated with a similarly constructed ICF block positioned in vertical arrangement thereto. In still another embodiment, the web member is a one-piece member which is slidably engageable with the pair of bracket members thereby allowing the ICF blocks to be field assembled at the construction site.

78 Claims, 18 Drawing Sheets

(56) References Cited

U.S. PATENT DOCUMENTS

| | | | |
|---|---|---|---|
| 4,229,920 | A | 10/1980 | Lount |
| 4,241,555 | A | 12/1980 | Dickens et al. |
| 4,332,119 | A | 6/1982 | Toews |
| 4,418,884 | A | 12/1983 | Schimmel |
| 4,463,925 | A | 8/1984 | Schimmel |
| 4,465,257 | A | 8/1984 | Schimmel |
| 4,519,568 | A | 5/1985 | Day et al. |
| 4,604,843 | A | 8/1986 | Ott et al. |
| 4,698,947 | A | 10/1987 | McKay |
| 4,706,429 | A | 11/1987 | Young |
| 4,730,422 | A | 3/1988 | Young |
| 4,731,968 | A | 3/1988 | Obino |
| 4,765,109 | A | 8/1988 | Boeshart |
| 4,884,382 | A | 12/1989 | Horobin |
| 4,885,888 | A | 12/1989 | Young |
| 4,886,891 | A | 12/1989 | Torii et al. |
| 4,888,931 | A | 12/1989 | Meilleur |
| 4,889,310 | A | 12/1989 | Boeshart |
| 4,901,494 | A | 2/1990 | Miller et al. |
| 4,969,626 | A | 11/1990 | Strauch |
| 5,065,561 | A | 11/1991 | Mason |
| 5,123,222 | A | 6/1992 | Guarriello et al. |
| 5,323,578 | A | 6/1994 | Chagnon et al. |
| 5,390,459 | A | 2/1995 | Mensen |
| 5,428,933 | A | 7/1995 | Philippe |
| 5,459,971 | A | 10/1995 | Sparkman |
| 5,568,710 | A | 10/1996 | Smith et al. |
| 5,570,552 | A | 11/1996 | Nehring |
| 5,625,989 | A | 5/1997 | Brubaker et al. |
| 5,679,279 | A | 10/1997 | Schmidgall |
| 5,701,710 | A | 12/1997 | Tremelling |
| 5,704,180 | A | 1/1998 | Boeck |
| 5,735,093 | A | 4/1998 | Grutsch |
| 5,809,728 | A | 9/1998 | Tremelling |
| 5,845,449 | A | 12/1998 | Vaughan et al. |
| 5,890,337 | A | 4/1999 | Boeshart |
| 5,896,714 | A | 4/1999 | Cymbala et al. |
| 6,230,462 | B1 | 5/2001 | Beliveau |
| 6,401,419 | B1 | 6/2002 | Beliveau |
| 6,668,503 | B2 | 12/2003 | Beliveau |
| 6,739,102 | B2 | 5/2004 | Roy, Sr. |
| 6,792,729 | B2 * | 9/2004 | Beliveau ..... 52/426 |
| 6,820,384 | B1 | 11/2004 | Pfeiffer |
| 6,915,613 | B2 | 7/2005 | Wostal et al. |
| 7,082,731 | B2 | 8/2006 | Patz et al. |
| 7,082,732 | B2 | 8/2006 | Titishov |
| 7,409,801 | B2 | 8/2008 | Pfeiffer |
| 7,827,752 | B2 | 11/2010 | Scherrer |
| 8,037,652 | B2 | 10/2011 | Marshall et al. |
| 2002/0162294 | A1 | 11/2002 | Beliveau |
| 2003/0000169 | A1 | 1/2003 | Davidsaver |
| 2003/0213198 | A1 | 11/2003 | Bentley |
| 2005/0028467 | A1 | 2/2005 | Bentley |
| 2005/0053429 | A1 | 3/2005 | Davidsaver et al. |
| 2005/0108963 | A1 | 5/2005 | Wostal et al. |
| 2007/0175155 | A1 | 8/2007 | Cymbala et al. |
| 2007/0294970 | A1 | 12/2007 | Marshall et al. |
| 2008/0028709 | A1 | 2/2008 | Pontarolo |
| 2009/0249725 | A1 | 10/2009 | Mcdonagh |
| 2011/0131911 | A1 | 6/2011 | Mcdonagh |
| 2012/0085047 | A1 | 4/2012 | Hiscock et al. |
| 2012/0096797 | A1 | 4/2012 | Garrett |

OTHER PUBLICATIONS

Formtech Insulated Concrete Forms (ICFs) picture gallery, accessed Aug. 10, 2007; <http://www.formtechsys.com/photogallery>.

* cited by examiner

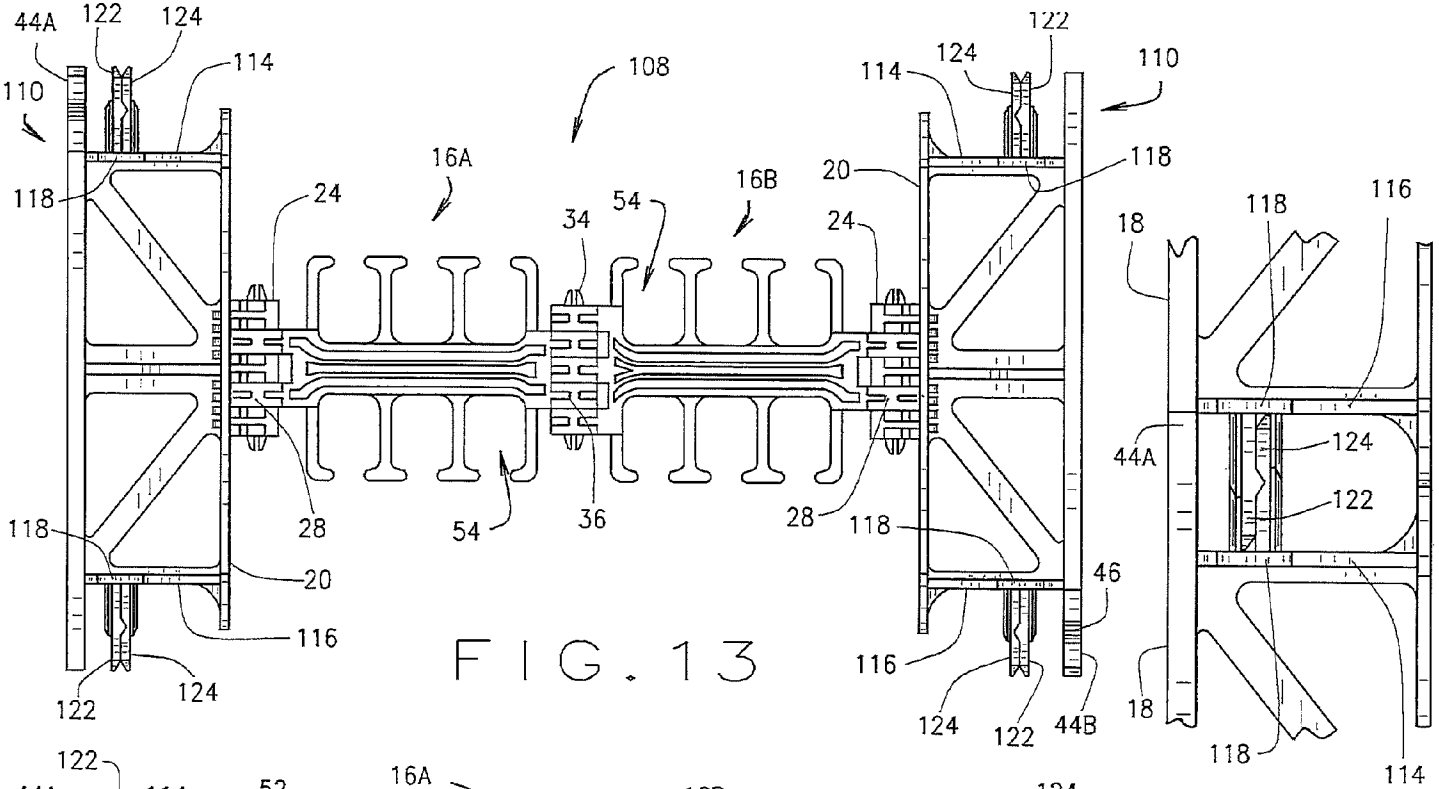
FIG. 13
FIG. 16
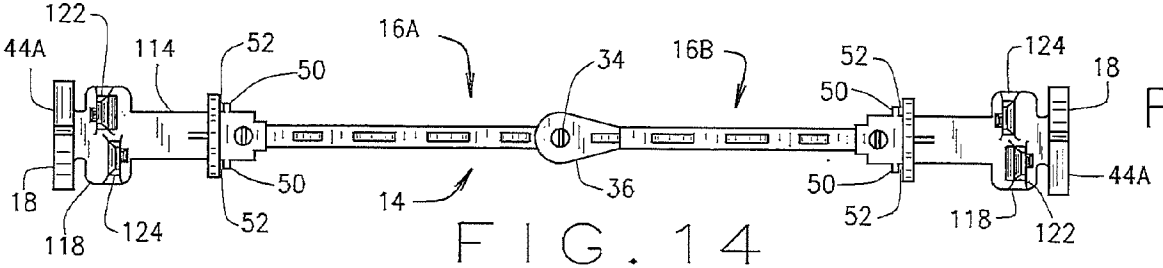
FIG. 14

INSULATING CONCRETE FORM (ICF) SYSTEM WITH TIE MEMBER MODULARITY

BACKGROUND OF INVENTION

The present invention relates to Insulating Concrete Form (ICF) Systems utilizing foam block forms or other forms made of other comparable materials and, more particularly, to improvements to the ICF panels and the interlocking connection means associated therewith thereby achieving product modularity with respect to ICF block forms having different heights and widths.

Insulating Concrete Form (ICF) Systems are well known in the industry and serve to both contain fluid concrete while it solidifies and provide insulation for the finished structure. Such systems utilize a plurality of individual units, panels or blocks aligned horizontally and vertically in an interlocking arrangement to create forms for concrete walls. Each block comprises a pair of panels which are retained in a spaced relationship parallel to each other through the use of a plurality of spacing or connecting tie members. As the ICF blocks are stacked, steel rebar rods are inserted at proper longitudinal and vertical integrals as in the conventional forming of a concrete wall.

There are a wide variety of different ICF systems presently available on the market, all of which are used to construct concrete walls. Some ICF systems utilize prefabricated block forms in which opposing flanges of each tie member are molded into the respective opposing walls or panels forming the block. In some prior art designs, the web portion extending between the opposed flanges of the tie are fixed relative thereto, and in some embodiments, the web portion of each respective tie member is hinged so as to allow the ICF block to be folded into a collapsed condition for transportation and storage. In still other embodiments, the ICF system is designed for field installation and the intermediate web portion associated with each respective tie member is slidably engageable with the opposed flanges of each respective tie member which are molded into the opposing walls or panels of each respective block. Once a particular wall or structure is formed using a particular ICF system, the wall or structure is braced and poured full with fluid concrete. The result is a highly energy efficient, steel reinforced, easy to construct, concrete wall having a layer of foam or other comparable material on each side of the concrete which serves as further insulation for the completed wall. The tie members which hold the ICF blocks together during the forming and pouring process also serve as furring strips for the attachment of interior (drywall) and exterior finishes.

Because the construction of each building structure is different and unique unto itself, and because of the specific needs of the building and construction industry, it is necessary to provide ICF blocks in a wide variety of different heights, widths and types including such types as straight forms, 90° and 45° corner forms, tapered top forms, ledge forms, T-wall forms, and many more. Although many different types of ICF systems are offered in the marketplace, the preassembled flat wall ICF system dominates the marketplace. In this regard, most of the major ICF companies offer five different widths and one height of ICF blocks to accommodate various construction needs. As a result, as the width of the respective ICF blocks change, so does the size and shape of the respective connecting tie members. If you wanted to also change the height of the respective blocks, not only does the size and shape of the connecting tie members change, but the size of the block panels likewise changes. All of these changes in block height and width also require tooling changes to produce the many different variations in ICF block heights and widths.

Due to the high capital costs required to make the molding tools for both the tie members and the ICF blocks in multiple widths, ICF companies have not been able to offer a more modular system that offers a standard line of ICF blocks in multiple heights as well as multiple widths. Currently, besides being costly, the ICF tools which are used to form the connecting tie members and the opposed block panels are extremely inflexible in their design, use and implementation. As a result, each different height of ICF block requires a different ICF tool for both forming the opposed foam panels of each respective block and for forming the connecting tie members associated therewith. The same is likewise true with respect to each different width of ICF block. In this regard, a separate plastic injection tie tool must also be purchased for each plastic tie used in a particular ICF block depending upon the width and height involved. If five different widths of tie members are used in one height of a particular ICF block, five different plastic injection tie tools must be used in order to make five different widths in one height. As a result, once a particular ICF tool is hung for use, it can only make one type of block, for example, a straight block in only one width. If a user needs an 11-inch straight block, an ICF company must hang its 11-inch wide straight tool of one particular height and it will then make 11-inch wide straight blocks of one particular height. When 13-inch wide straight blocks are needed, the 11-inch wide straight tool must be taken down and the 13-inch wide tool is hung. This process occurs every time a different type of block of a specific width needs to be produced.

As the height of each ICF block changes, so does its tooling requirements. The height of each ICF block requires a different size tool cavity for each different height. Having to switch out tools in this matter is time consuming and costly for two reasons. First, it currently takes most ICF manufacturers an average of several hours to unload one ICF block tool and hang another tool. This reduces the number of ICF blocks that can be produced in a particular day on a particular machine and therefore increases the respective costs of those blocks actually made. Secondly, each ICF block tool that is hung can only make a certain number of ICF blocks in each forming cycle. Tools made only a couple of years ago were made to run on smaller machines and therefore have fewer cavities. Most existing ICF block tools have only two cavities. Increasing the number of cavities in each respective tool likewise increases productivity and reduces cost as more blocks can be made within the same forming cycle. As a result, because of the costs involved in purchasing all of the various tooling for providing a full line of ICF products having different widths and heights, most ICF manufacturers only provide the most common and highest volume ICF block widths and heights.

It is therefore desirable to provide an improved fully integrated ICF system which would reduce the number of tools required to form a plurality of different ICF blocks having both different widths and different heights, which would promote modularity between the different types, widths and heights of ICF blocks such that the same connecting tie members can be used for all variations thereof, and which improves the efficiency and flexibility in the ICF manufacturing process. It is also desirable to provide improved connecting tie members which are both modular and foldable such that the same basic tie member can be used in a single tool to make ICF blocks of varying heights and such that all of the various ICF block embodiments can fold flat for packaging, storage, shipping, sight storage and sight staging. Other additional improvements to the overall ICF block and tie design are likewise desirable to improve the stacking and engaging features of the respective ICF blocks as they are stacked vertically and horizontally to construct different types of concrete walls.

Accordingly, the present invention is directed to overcoming one or more of the problems as set forth above and will enable an ICF manufacturer to go from making 18 to 20 standard ICF blocks to offering an integrated ICF product line of more than 160 different preassembled folding and field assembled ICF block configurations.

SUMMARY OF INVENTION

In accordance with the teachings of the present invention, several embodiments of an improved ICF tie member as well as improved opposed ICF panel members are disclosed wherein all such improvements promote efficiency, flexibility and modularity in manufacturing ICF blocks of varying widths and heights. The present improvements therefore overcome the weaknesses and disadvantages associated with prior art ICF block, panel and tie designs and teach a more versatile and flexible modular tie, panel and block design. In one aspect of the present invention, the present ICF blocks are pre-constructed units including a plurality of foldable tie members spaced apart from, and parallel to, one another. In another aspect of the present invention, the present ICF blocks are field assembled and the plurality of tie members used in association therewith are non-foldable and slidably engageable with opposed side wall brackets embedded in the respective ICF panel members. Although the present ICF blocks and panels disclosed herein will be discussed in conjunction with a substantially planar or straight block configuration, it is recognized and anticipated that the ICF blocks and panels of the present invention can be constructed in any of a variety of different configurations including, but not limited to, a 90° corner block, a 45° corner block, a taper top block, a ledge form block, a T-wall shaped block and other configurations. All of the present ICF blocks are designed to yield a solid, continuous concrete wall construction when connected horizontally and vertically to blocks of similar construction.

Each of the present block configurations includes an opposing pair of ICF panels made of foam or some other comparable material. Identical arrays of alternating teeth and sockets are formed along opposing horizontal longitudinal edges of each panel forming the present ICF block so as to enable it to be removably engaged with either opposing horizontal longitudinal edge of a similarly constructed ICF block when such blocks are vertically stacked one on top of another. The array of alternating teeth and sockets are placed in the center of each of the opposed horizontal longitudinal edges of each of the present ICF panels away from the opposed side edge portions thereof. This median location of the array of alternating teeth and sockets facilitates a cleaner outside exterior wall surface and reduces the amount of wall preparation work that will be needed with certain exterior finish applications. In one embodiment, the opposing vertical end edges of respective panels may also include any number of alternating teeth and sockets which will mate with a substantially identical array of alternating teeth and sockets formed along either vertical end edge of a similarly constructed block for creating an interlocking bond therebetween when such horizontally adjacent panels are mated with each other.

As a result, all of the present ICF blocks constructed in accordance with the teachings of the present invention can vertically and horizontally engageably receive adjacent whole or partially whole blocks of the present invention regardless of the vertical orientation with regard to its horizontal longitudinal axis and regardless of the horizontal orientation with regard to its vertical axis. This is true whether the present ICF blocks are preassembled as a single unit or field assembled at the construction site. The same is likewise true with respect to any other block configuration such as a 90° corner block or other configuration. In addition, the medial location of the array of alternating teeth and sockets likewise enables each tooth to engage a corresponding socket on all four sides of each respective tooth thereby improving the overall strength of the interlocking engagement.

In another aspect of the present invention, one embodiment of a connecting tie member includes a stackable folding tie member having a pair of opposed side wall brackets, a pair of connector link members, and a plurality of pin members for pivotally attaching the connecting link members to each other and to the respective side wall brackets for enabling the opposed ICF panels to fold flat relative to each other for packaging, storage, shipping, site storage and site staging. This folding capability also allows the same basic tie member construction to be used in a single ICF block tool for producing ICF blocks of different widths. The respective side wall brackets are each respectively encapsulated within one of the pair of ICF panels forming the particular ICF block. Each side wall bracket includes a fastening plate having an overlapping extension portion associated with each opposite end portion thereof, a shut-off plate positioned in parallel relationship thereto, and a plurality of bridging members for connecting the fastening plate to the shut-off plate. When encapsulated within a particular ICF panel, the shut-off plate is positioned adjacent the inner wall of each respective panel member and the fastening plate is positioned either adjacent the outer wall of each respective ICF panel, or spaced therefrom depending upon the thickness of the ICF panel.

The fastening plate overlapping extension members may have engaging means associated therewith designed to cooperatively engage the fastening plate overlapping extension members associated with a similarly constructed side wall bracket associated with a similarly constructed ICF panel. The overlapping extension members extend into the teeth area of each respective opposed horizontal longitudinal edge of each panel and will allow mated ICF blocks to further lock in place when stacked on top of each other. This feature also allows a plurality of side wall brackets to be encapsulated within a particular ICF panel in interlocking relationship to each other so as to form a plurality of different heights of ICF blocks as will be hereinafter discussed.

In another embodiment, each side wall bracket of the present tie member may further include interlocking mechanisms in the form of a pair of offset members associated with each opposite end portion thereof, the interlocking mechanisms associated with one tie member likewise extending into the teeth area of each respective opposed horizontal longitudinal edge of each ICF panel for cooperatively engaging corresponding interlocking mechanisms associated with a similarly constructed tie member associated with a similarly constructed ICF panel so as to allow mated ICF blocks to further lock in place when stacked on top of each other.

Each shut-off plate likewise includes a side wall bracket hinge configuration adapted to receive corresponding hinge members associated with the connection link members. This connection is made through a pin member which pivotally attaches one end portion of each respective connection link member to a corresponding side wall bracket. The opposite end portion of each pair of connection link members likewise includes cooperatively engageable hinge members which are likewise connected together through the use of a similar pin member. When the pair of connection link members are pivotally attached to each other and to the respective side wall brackets, a complete folding tie member is formed. Depending upon the length of each respective preassembled ICF block, a plurality of the present tie members will be spaced longitudinally along its length thereby enabling each respective ICF block to fold flat for packaging, shipping and storage. Once the forms are ready to be stacked for use at a particular construction site, they are simply opened, stabilized and stacked to build the walls of a particular structure.

The modularity of the present tie members enables the present ICF blocks to be manufactured in a wide variety of different heights and widths. In this regard, the width of a particular ICF block can be easily changed by merely changing the overall length of the respective pair of connection link members. The corresponding side wall brackets will remain the same and the pivotally attaching connection means associated with both the shut-off plate of each respective side wall bracket and the opposite end portions of each connection link member will likewise remain the same. As a result, only the length of the connection link members need be changed in order to change the width of a particular ICF block. This saves both tooling costs and manufacturing costs since only the connection link members need to be retooled for a different width.

Changing the overall height of a particular ICF panel is likewise easily achieved due to the modularity of the present ICF tie member. Depending upon the overall height selected for the present stackable folding tie member, various ICF block heights based upon multiples of the pre-selected height of the tie member can be easily fabricated by simply stacking any plurality of the present stackable folding tie members within a particular ICF block molding tool and forming the same. For example, if the present ICF stackable folding tie member is 6 inches in height, ICF blocks having heights of any multiple of 6 inches such as 12 inches, 18 inches and 24 inches, can be easily fabricated without changing the design or tooling requirements associated with fabricating the tie members associated therewith. A 12-inch tall ICF block will utilize a pair of the present 6-inch tie members stacked on top of each other at spaced locations along the longitudinal length of the particular ICF block. An 18-inch tall ICF block will require the stacking of 3 of the present 6-inch tie members and a 24-inch tall ICF block will require the stacking of 4 of the present 6-inch tie members. This stackability in conjunction with the locking feature associated with each of the respective side wall bracket members enables an ICF manufacturer to produce ICF block heights in multiples of the selected tie member height. This ability saves time and cost since the same basic ICF tie member is used in multiples of each other to produce ICF blocks of varying heights. It is also recognized that all ICF blocks can be made of a single height such as 6 inches tall and the blocks can be stacked in multiples to achieve a desired height based upon multiples of the pre-selected height of the ICF block. It is also recognized that the ICF blocks can be made of several different heights such as 6-inch tall and 8-inch tall blocks and these blocks can then be stacked using any combination of such blocks to achieve a desired height based upon the pre-selected heights of the ICF blocks. This ability also gives a designer more design flexibility and will allow a designer to hit different wall heights more easily and efficiently thereby reducing labor time and costs as will be hereinafter further explained.

Each of the connection link members likewise includes a plurality of rebar-retaining seats formed thereon so that a rebar rod can be gravitationally placed within a given seat regardless of vertical orientation of the ICF block with respect to its horizontal longitudinal axis. The rebar-retaining seats of each tie member are of sufficient dimension to allow at least one or two rebar rods to be retained therein without imparting undesirable torque forces to the tie member.

In another aspect of the present invention, a field assembled ICF block is disclosed utilizing an improved field assembled connecting tie member. The field assembled connecting tie member is likewise modular in form and includes a pair of side wall brackets which are embedded or encapsulated in opposed relationship to each other in the opposed ICF panel members foaming one of the present ICF blocks, and a single web member which is slidably engageable with the respective side wall brackets. The side wall brackets associated with the field assembled tie member are substantially similar to the side wall brackets associated with the present folding tie member except that the bracket hinge members associated with the shut-off plate have been eliminated and a slot has been formed in the shut-off plate for cooperatively receiving one end portion of the web member. In some embodiments, the slot associated with the respective shut-off plates may be tapered and/or enlarged at each opposite end portion to enable the web member to be easily inserted at any intermediate location along the height of a particular ICF panel or block. In all other respects, the side wall brackets associated with the field assembled tie member are substantially identical to the side wall brackets associated with the present folding tie member including having overlapping engagement means associated with the fastening plate and/or interlocking mechanisms in the form of a pair of offset members associated with each opposite end portion thereof for stackably engaging any plurality of the field assembled tie members as previously explained with respect to the present stackable/folding tie member.

The web member associated with the field assembled tie member is likewise designed to provide centralized structural support to the ICF block when cooperatively engaged with its corresponding side wall brackets. In this regard, the opposite end portions of the field assembled web member may include cooperatively engageable means for slidably engaging the respective slots associated with the shut-off plate of the respective side wall bracket members. The opposite end portions of the web member likewise may include a plurality of teeth or other engaging means for cooperatively engaging a corresponding set of teeth or other engaging means associated with the side wall bracket slots for holding the web member in proper position when engaged with the respective side wall brackets. In another embodiment, the web member may also include a resilient hook type or snap locked member at one or both opposite ends of each opposed end portion for engaging the respective side wall brackets for holding the web member in proper position when engaged with the side wall brackets. Similarly, the web member likewise includes a plurality of rebar-retaining seats formed thereon for receiving a rebar rod placed therein prior to pouring the fluid concrete between the respective ICF panels. Because the present field assembled web member is slidably engageable with its corresponding side wall brackets, the ICF panel members can be individually formed and shipped to a particular construction site in its unassembled state thereby saving space for packaging, storage and shipping of the respective ICF panel members to a particular location. This likewise reduces the on-site storage room needed and reduces the staging costs associated with larger multi-story ICF structures. The present field assembled ICF blocks can be easily assembled on site by merely engaging the corresponding web members with a pair of corresponding side wall brackets to complete the assembly process.

Like the present stackable/foldable spacing tie members, the modular nature of the present field assembled tie members likewise promotes economy of scales with respect to manufacturing ICF blocks of different widths and heights. As with the present stackable/foldable tie member, the web member associated with the present field assembled tie member can likewise be made in different widths while utilizing the same side wall brackets. Here again, this reduces tooling costs and enables a manufacturer to produce a variety of different web member lengths to achieve the desired ICF block widths required by the industry. In similar fashion, field assembled ICF blocks of varying heights can likewise be easily produced in heights corresponding to the multiple heights of the field assembled tie members or corresponding to the multiple heights of the pre-selected ICF blocks as previously explained with respect to the present stackable/foldable tie member. The present field assembled tie member can likewise be made in the same widths and heights as the present stackable/foldable tie member thereby yielding field assembled ICF blocks having the same widths and heights as the present pre-assembled folding ICF blocks.

As a result, the various embodiments of the present tie member facilitate producing a wide variety of different ICF block widths and heights while saving tooling costs and manufacturing costs. Currently, a separate ICF tool must be made to produce each type of block in each width and in each height. In addition, the use of a triple hinged folding tie member likewise provides a manufacturer the ability to redesign its ICF molding tools in a way that will allow more than one size of ICF block to be made in each respective tool. This advancement is discussed in Applicant's co-pending application, the disclosures of which are incorporated herein by reference. The interchangeability of the present stackable/folding and field assembled side wall brackets enable the present ICF blocks to be made in a wide variety of different widths and different heights and also opens the door for more creative block designs and configurationg due to its modular capability. The different embodiments of the present tie members can be incorporated into any ICF block structure in accordance with the teachings of the present invention.

These and other advantages of the present invention will become more apparent to those skilled in the art after consideration of the following specification taken in conjunction with the accompanying drawings wherein similar characters or reference numbers refer to similar structures in each of the separate views.

BRIEF DESCRIPTION OF DRAWINGS

For a better understanding of the present invention, reference may be made to the accompanying drawings.

FIG. 13 is a side elevational view of the tie member of FIG. 12.

FIG. 14 is a top plan form view of the tie member of FIG. 12.

FIG. 16 is a partial side elevational view of two of the tie members of FIG. 12 positioned in interlocking relationship with each other.

DETAILED DESCRIPTION

Figure 1:
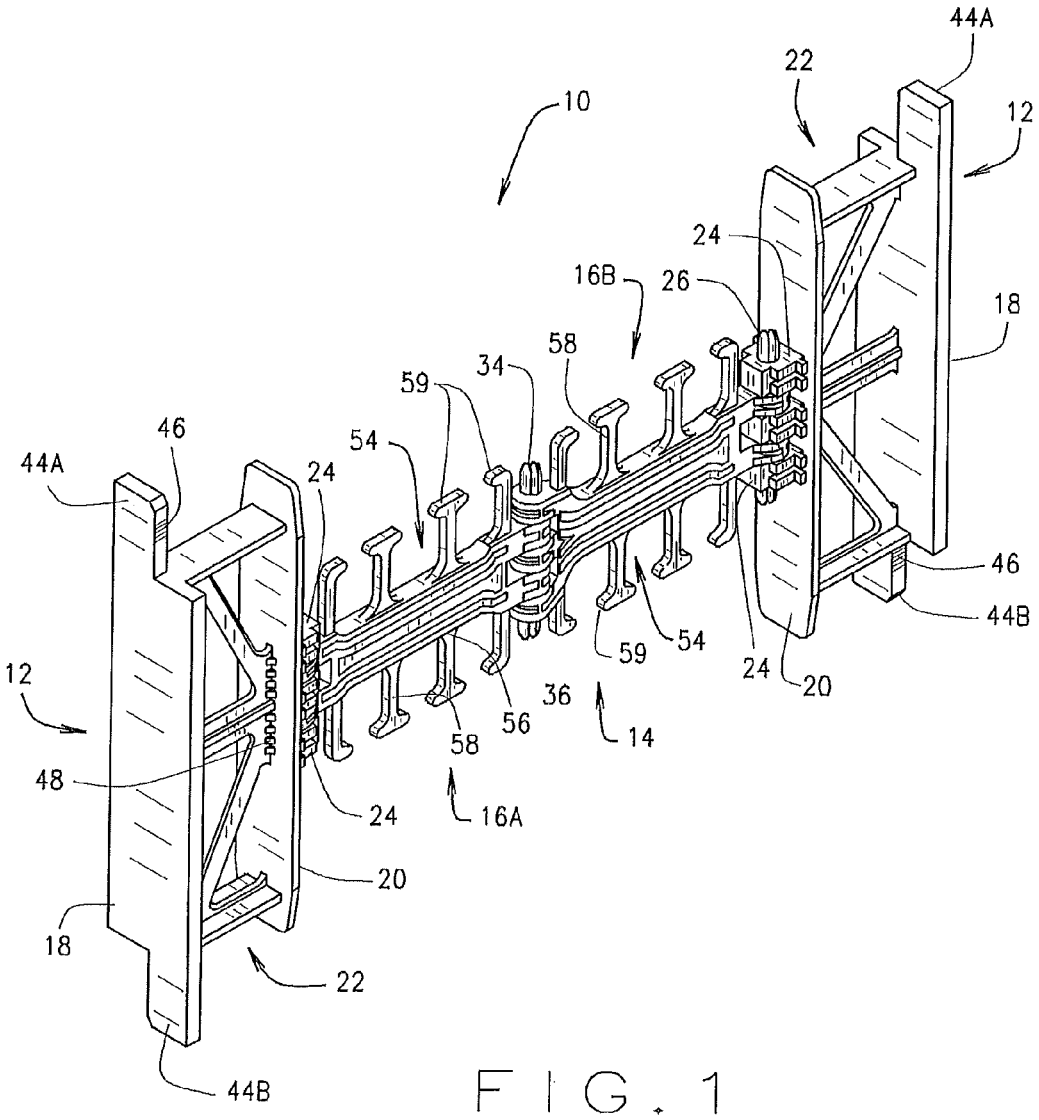
FIG. 1 is a perspective view of one embodiment of a stackable/foldable tie member constructed according to the teachings of the present invention.
Figure 2:
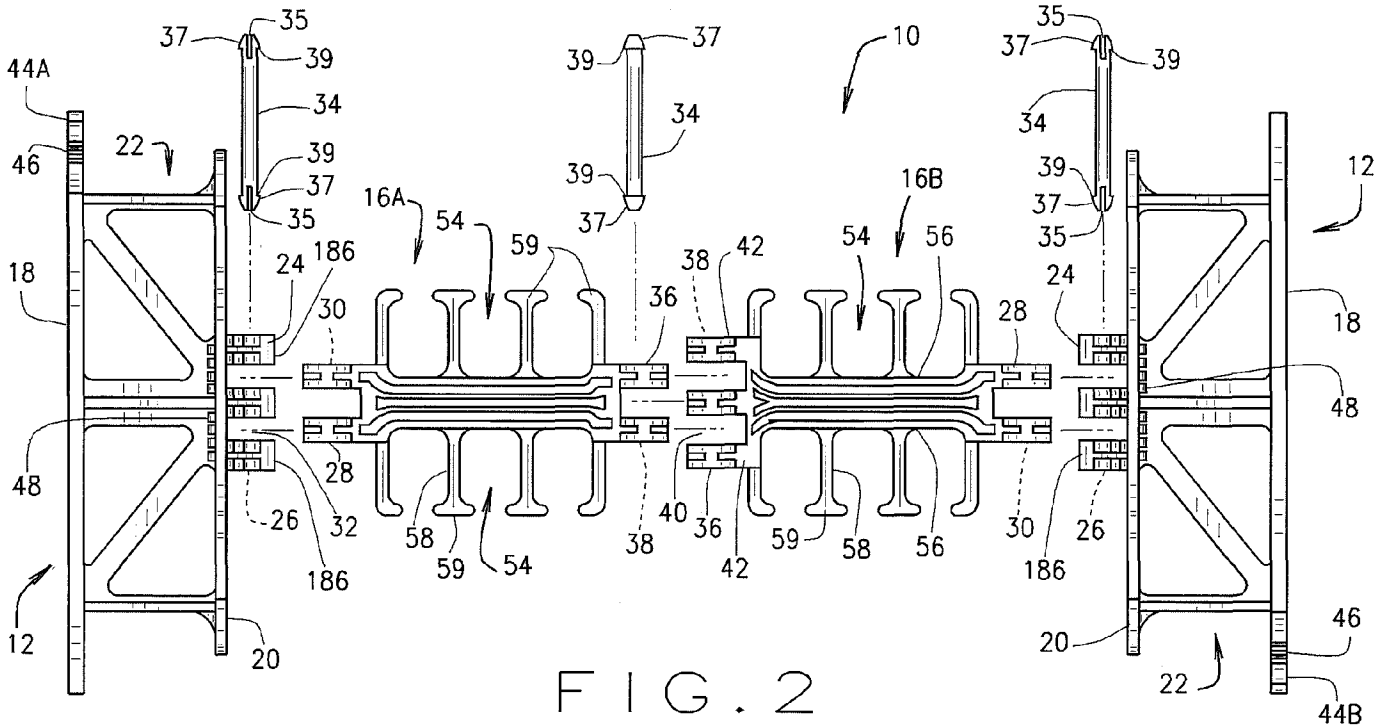
FIG. 2 is an exploded side elevational view of the tie member of FIG. 1.
Figure 3:
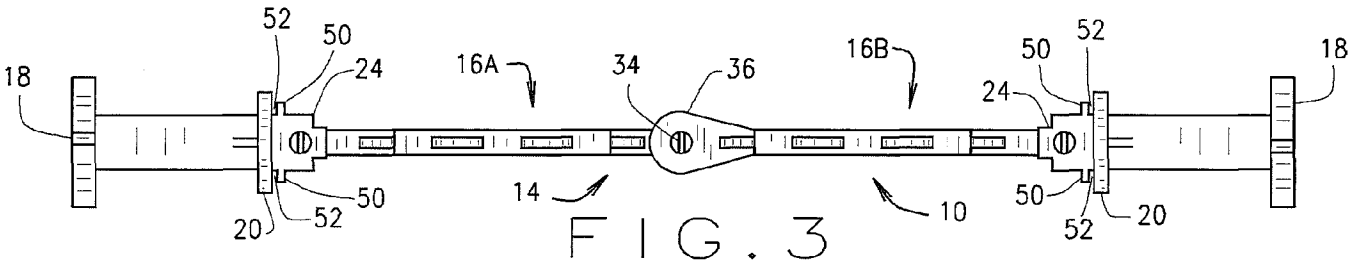
FIG. 3 is a top plan form view of the tie member of FIG. 1.

Referring to the drawings more particularly by reference numbers wherein like numbers refer to like parts, the numeral 10 in FIGS. 1-3 identify one embodiment of a stackable/foldable spacing tie member constructed according to the teachings of the present invention. Although use of the present tie member 10 will be discussed herein in relationship to a substantially planar or straight ICF block, it is recognized and anticipated that the present tie member 10 can be utilized with a wide variety of different types of ICF blocks including a 90° corner block, a 45° corner block, taper top blocks, ledge form blocks, and so forth. As will likewise be discussed herein, it is also recognized that the present tie member assembly 10 constructed according to the teachings of the present invention can likewise be fashioned into a variety of different sizes and shapes other than those illustrated herein without departing from the spirit and scope of the present invention and that the other components associated with the present tie member assembly 10 may likewise be correspondingly shaped to conform to the shape of the overall assembly without departing from the teachings and the practice of the present invention.

The present stackable/foldable tie member 10 is modular in form as best illustrated in FIG. 2 and includes a pair of opposed side wall brackets 12 separated by, and connected to, a web portion 14. The web portion 14 includes a pair of cooperatively engageable connection link members 16A and 16B as best illustrated in FIG. 2. Importantly, the side wall bracket members 12 are identical in structure to each other and the connection link members 16A and 16B are likewise substantially identical in structure to each other except for the number of hinge projection members associated in the center of the overall tie member 10 as will be hereinafter explained. Although the tie member 10 is typically constructed from a suitable plastic material, in other embodiments, the tie member 10 can be constructed of metal or other suitable materials.

Each side wall bracket member 12 includes a fastening plate 18, a spaced apart shut-off plate 20, and a plurality of bridging members connected therebetween forming a truss structure 22 therebetween. The truss structure 22 provides support and stability to the respective plate members 18 and 20 and to the overall side wall bracket 12.

The shut-off plate 20 includes a plurality of spaced apart projections 24 as best illustrated in FIG. 2, each projection 24 having an opening 26 extending therethrough. One end portion of each of the respective connection link members 16A and 16B includes a complimentary plurality of spaced projections 28 likewise having an opening 30 extending respectively therethrough, the projections 28 being positioned and located so as to be slidably received within the spaces 32 located between the side wall bracket projections 24 as best illustrated in FIGS. 1 and 2. When the projections 28 associated with one end portion of each respective connection link members 16A and 16B are cooperatively engaged with the corresponding side wall bracket projections 24, the respective openings 26 and 30 are aligned and are adapted to receive a pin member 34 therethrough as will be hereinafter further explained. Once pin member 34 is engaged with the respective projection members 24 and 28, each respective connection link members 16A and 16B is pivotally attached to the side wall bracket member 12 adjacent the shut-off plate 20. The projections 24 and 28 function as cooperatively engaged hinge members.

The opposite end portion of one of the respective connection link members 16A and 16B, such as link member 16A likewise includes at least a pair of spaced apart projections or hinge members 36 each including a respective opening 38 extending therethrough. The other connection link member, such as link member 16B, includes three (3) complimentary spaced apart projections or hinge members 36 each likewise including a respective opening 38 extending therethrough. The hinge projection members 36 associated with one end portion of the connection link member 16A are likewise positioned and located as best illustrated in FIG. 2 so as to be slidably engaged with the three (3) hinge projection members 36 associated with connection link member 16B at the center of the tie member 10 such that the members 16A and 16B and their respective transverse bridge members 56 are in alignment with each other as best shown in FIG. 1. This enables the link members 16A and 16B to be cooperatively engaged by sliding one of the respective hinge projection members 36 associated with one link member 16A into the spaces 40 provided between the hinge projections members 36 associated with the other link member 16B as illustrated in FIG. 2. Once engaged, the corresponding openings 38 associated with the engaged hinge projection members 36 are aligned with each other and are adapted to receive another pin member 34 therethrough. Insertion of the pin member 34 within the aligned openings 38 completes the pivotal attachment between the opposed end portions of the respective connection link members 16A and 16B at the center of the overall tie member 10. When so connected, the tie member 10 is hinged at three separate locations as best illustrated in FIG. 3 and is pivotable about each of the respective pin members 34 for reasons which will be hereinafter further explained.

Use of five (5) cooperatively engageable hinge projection members 36 at the center of the overall tie member 10 improves the strength and durability of the center hinge. Nevertheless, it is recognized that any number of hinge projection members 36 may be used at the center of the overall tie member 10 including the use of the same number of hinge projection members 36, such as a pair of projection members 36, if so desired without departing from the spirit and scope of the present invention. In this event, the projection members 36 associated with one of the link members would be slightly offset from the projection members 36 associated with the other link member so that such projection members can be cooperatively engaged with the other. It is also recognized that any plurality of hinge projection members can be utilized on either end of each link member 16A and 16B as well as with each shut-off plate 20 so long as they are compatible with each other and with the hinge projection members associated with the shut-off plates 20.

In similar fashion, each pin member 34 is substantially identical in construction and includes a slotted end portion 35 associated with each opposite end portion thereof. The respective slotted end portions 35 are formed by flange portions 37 which are arrowhead in shape. The slots 35 enable the pin member flange portions 37 to flex inwardly during insertion into any one of the openings 26, 30 and 38 associated with the respective hinge members 24, 28 and 36. The arrowhead shape associated with the tip or end portion of each respective pin flange portion 37 likewise facilitates insertion of the respective pin members 34 within the respective openings. The arrowhead shaped end portion associated with each pin flange portion 37 likewise includes a tip or edge portion 39 which functions as a stop member and serves to stop the pin member 34 during the assembly process and prevents the pin from being pulled out since the top and bottom pin edge portions 39 will engage the top and bottom hinge projection members 24 and 36 once properly position therethrough. The center pin member 34 in FIG. 3 is rotated 90° as compared to the pin members located adjacent the side wall bracket members 12 to more clearly show the edge portions 39. Since both opposite end portions of the pin member are identically shaped and structured, either end portion of the respective pin members 34 can be initially inserted into the appropriate aligned hinge openings. Also, since the same pin member 34 is used to make all of the hinge connections associated with the present tie member 10, only one tool is necessary for manufacturing any number of pin members 34 for use with any ICF block height or width.

The top and bottom hinge projection members 36 associated with the pivotally joined connection link member 16B may include a thicker outer flange 42 to provide additional strength and stability to the pivotal connection. As illustrated in FIGS. 1 and 2, the hinge projection members 28 and 36 can be fabricated as cog type hinge members which are thicker towards their opposed top and bottom edges and thinner therebetween. This hinge member configuration produces a strong hinge member which minimizes the use of material thereby reducing cost. This configuration also reduces the cycle time required to make the connection link members 16 because the thickness of material is less and more uniform. These reduced cycle times also reduce costs.

Figure 7:
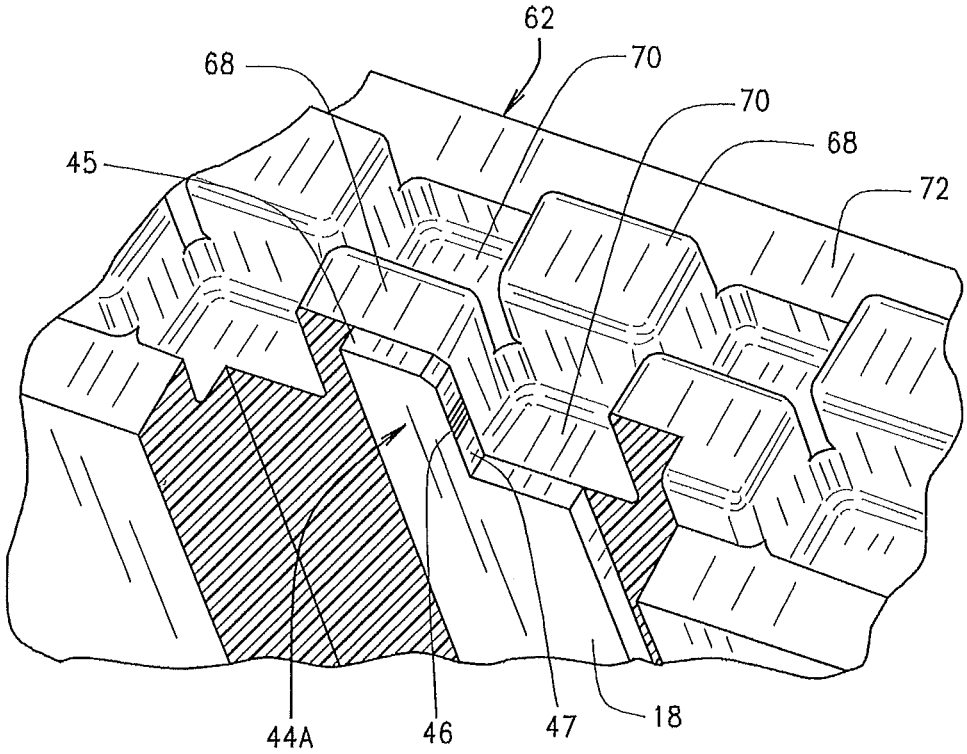
FIG. 7 is a partial cut-away perspective view showing the fastening plate extension members projecting into the interlocking teeth area associated with each ICF panel.
Figure 8:
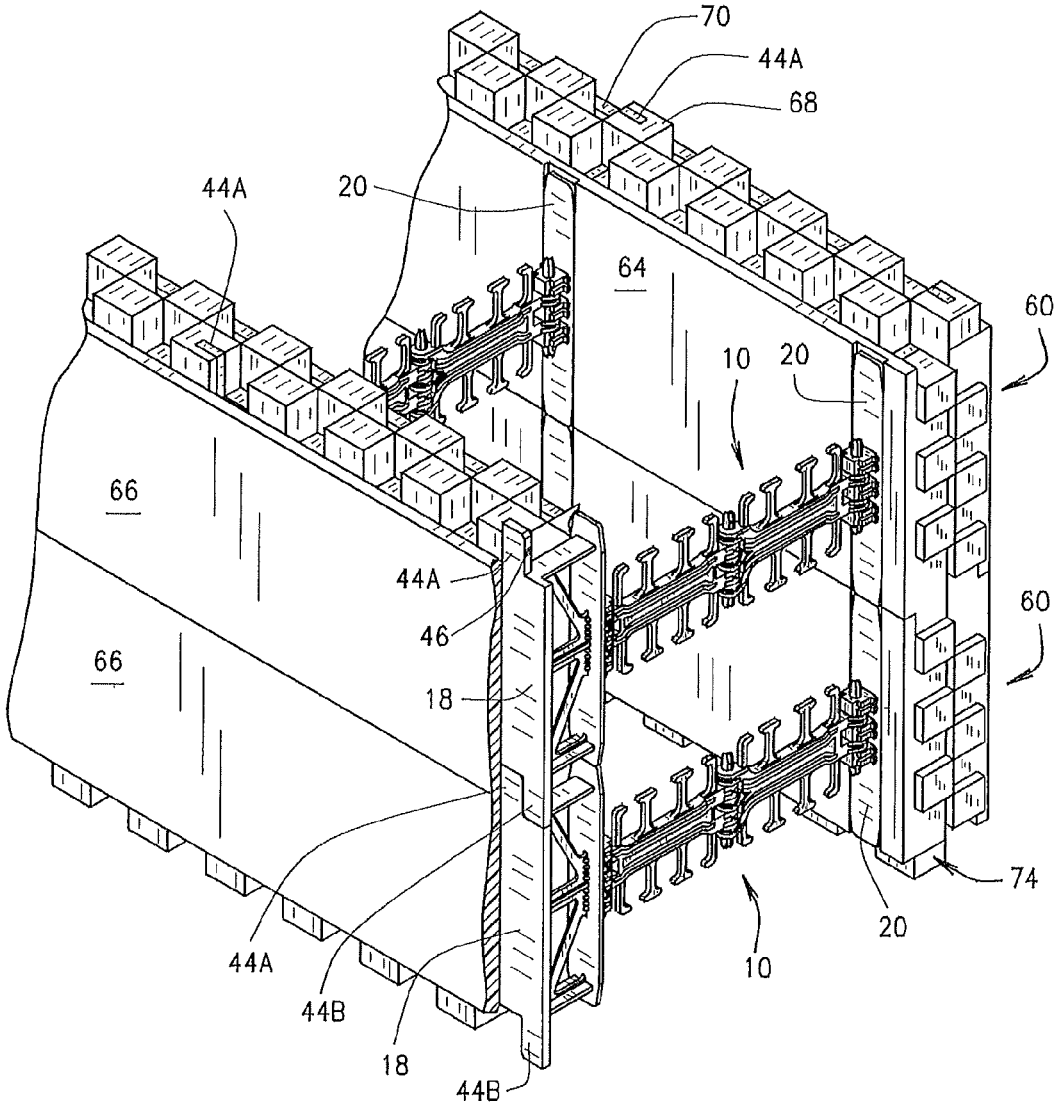
FIG. 8 is a partial perspective view of two of the ICF blocks of FIG. 4 positioned in vertical arrangement one on top of the other.

The fastening plate 18 associated with each opposed side wall bracket 12 likewise includes an overlapping extension end portion 44 positioned at each respective end portion thereof for allowing the respective ends of the tie fastening plate 18 to overlap each other and align themselves when the tie members 10 are stackably arranged one on top of the other as will be hereinafter further explained with reference to FIGS. 7 and 8. The fastening plate overlapping extension portion 44A illustrated in FIG. 1 is a mirror image of and is offset from its corresponding opposed extension portion 44B associated with the opposite end portion of the fastening plate 18. This offset arrangement enables the bottom portion of one side wall bracket member 12 to be overlapped and engaged with the top portion of another side wall bracket member 12 to achieve the stacking arrangement of the present invention. As best illustrated in FIG. 7, when the respective side wall brackets 12 are encapsulated within a particular ICF panel member 62, the extension portions 44A and 44B extend into the respective tooth area of the ICF panel as will be hereinafter further explained. In addition, each extension portion 44A and 44B includes an engaging or fastening member such as a plurality of teeth or gripper members 46 that will mate with and lock or grip with the corresponding teeth or gripper members 46 associated with an opposing tie member 10 which is stacked thereon. Since the fastening plate overlapping extension portions 44A and 44B extend into a tooth associated with the teeth and socket array on each respective ICF panel, when a similarly constructed ICF block is vertically positioned on top of another ICF block, not only will the respective arrays of alternating teeth and sockets engage each other, but the gripping means 46 associated with the respective extension members 44A and 44B will likewise engage each other in the interlocking teeth and socket area as illustrated in FIG. 8. This overlapping arrangement of the fastening plate extension portions 44A and 44B and their corresponding gripping means 46 further aids in interlocking two vertically stacked ICF blocks to one another. In addition, it is not uncommon for ICF blocks to lift and rise up as the fluid concrete fills the block cavity and rises to the top of the wall. Since the grippers or teeth 46 associated with the respective tie members 10 of vertically stacked ICF blocks 60 will engage each other and further lock and stabilize the interconnecting ICF blocks, the lifting and rising up of the respective blocks as the fluid concrete flows and fills the block cavity is substantially eliminated. This interaction of stacked ICF blocks 60 and stacked tie members 10 are best illustrated in FIG. 8.

Still further, each side wall bracket 12 further may include a reinforcing pad or an area of extra material 48 located on one side portion of the shut-off plate directly behind and opposite the side wall bracket hinge members 24 to increase the tensile strength of the shut-off plate 20 in the area of pivotable rotation of the connection link members 16A and 16B. The reinforcing pad 48 also increases the tensile strength of the folding capability of the overall tie structure.

In addition, as best illustrated in FIGS. 1-3, each of the side wall bracket hinge members 24 includes at least one set of opposed projections or fingers 50 which extend in a direction parallel to the plane of the shut-off plate 20, each of the projections 50 being in substantial alignment with each other and each set forming a corresponding slot 52 (FIG. 3) between the shut-off plate and the respective projections 50. The slots 52 formed by the aligned projection members 50 enable the respective side wall bracket members 12 to be grabbed by and secured within the ICF block forming tool as explained in Applicant's co-pending application. The projections 50 therefore function as tool engaging members for securing the present foldable tie member 10 within a particular tool cavity without the need for having a fixed width tie member positioned within the tool cavity. This improvement is discussed in Applicant's co-pending application. It is also recognized and anticipated that the opposed projections 50 could be a single member extending across the side wall bracket hinge members 24 in a direction parallel to the plane of the shut-off plate 20, or they could take on other shapes and configurations and they could extend in other directions as long as a slot such as slot 52 is formed to engage the ICF block forming tool. Other variations and modifications are likewise envisioned.

As best illustrated in FIGS. 1 and 2, each of the connection link members 16 includes at least one rebar seat 54. The rebar seats 54 are substantially identical to each other in configuration, and are arranged in a pair of opposing rows along opposite sides of the transverse bridge members 56. Each rebar seat 54 includes a substantially U-shaped well formed by a pair of adjacent fingers 58 and inwardly spanning lateral knuckles or projections 59 are formed on the distal end of each pair of adjacent fingers 58 thereby creating a distance between opposing projections 59 that is substantially less than the lateral distance between the adjacent fingers 58. The length of the fingers 58 can be chosen in conjunction with the lateral distance between such fingers to create a substantially U-shaped well or rebar seat 54 capable of retaining any number of rebar rods therein. Typically, the rebar seats 54 are dimensioned so as to retain either a pair of rebar rods or a single unstraight length of rebar rod without imparting undesirable torque to portions of the web structure 14. The knuckles or projections 59 associated with a given rebar seat 54 serve to help retain the rebar rod therein. The fingers 58 forming each rebar seat 54 may likewise be tapered inwardly towards each other to further facilitate the holding of the rebar rods within each respective seat 54.

Figure 4:
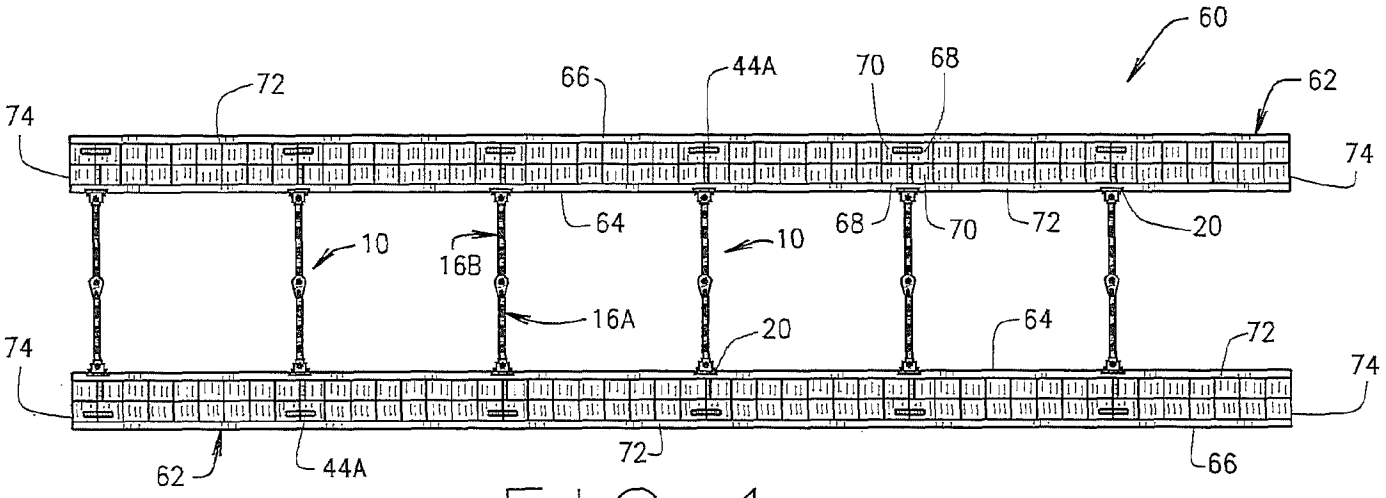
FIG. 4 is a top plan form view of a pre-constructed straight ICF form block of the present invention incorporating the stackable/foldable tie members of FIG. 1.
Figure 5:
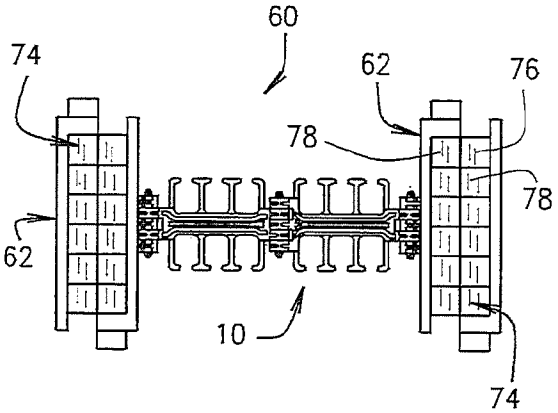
FIG. 5 is an end elevational view of the ICF block illustrated in FIG. 4.

A substantially straight or planar ICF block 60 having a pair of parallel opposing panel members 62 retained in spaced apart relationship to each other by a plurality of the present tie members 10 is illustrated in FIGS. 4 and 5. The plurality of tie members 10 extend transversely between opposing inner surfaces 64 of the opposing panel members 62 and the opposing side wall brackets 12 and truss structure 22 associated respectively therewith are substantially retainably encapsulated within the respective opposing panel members 62 such that each fastening plate 18 is seated inwardly from the outer surface 66 of the respective panel member 62 within which it is encapsulated.

Figure 6:
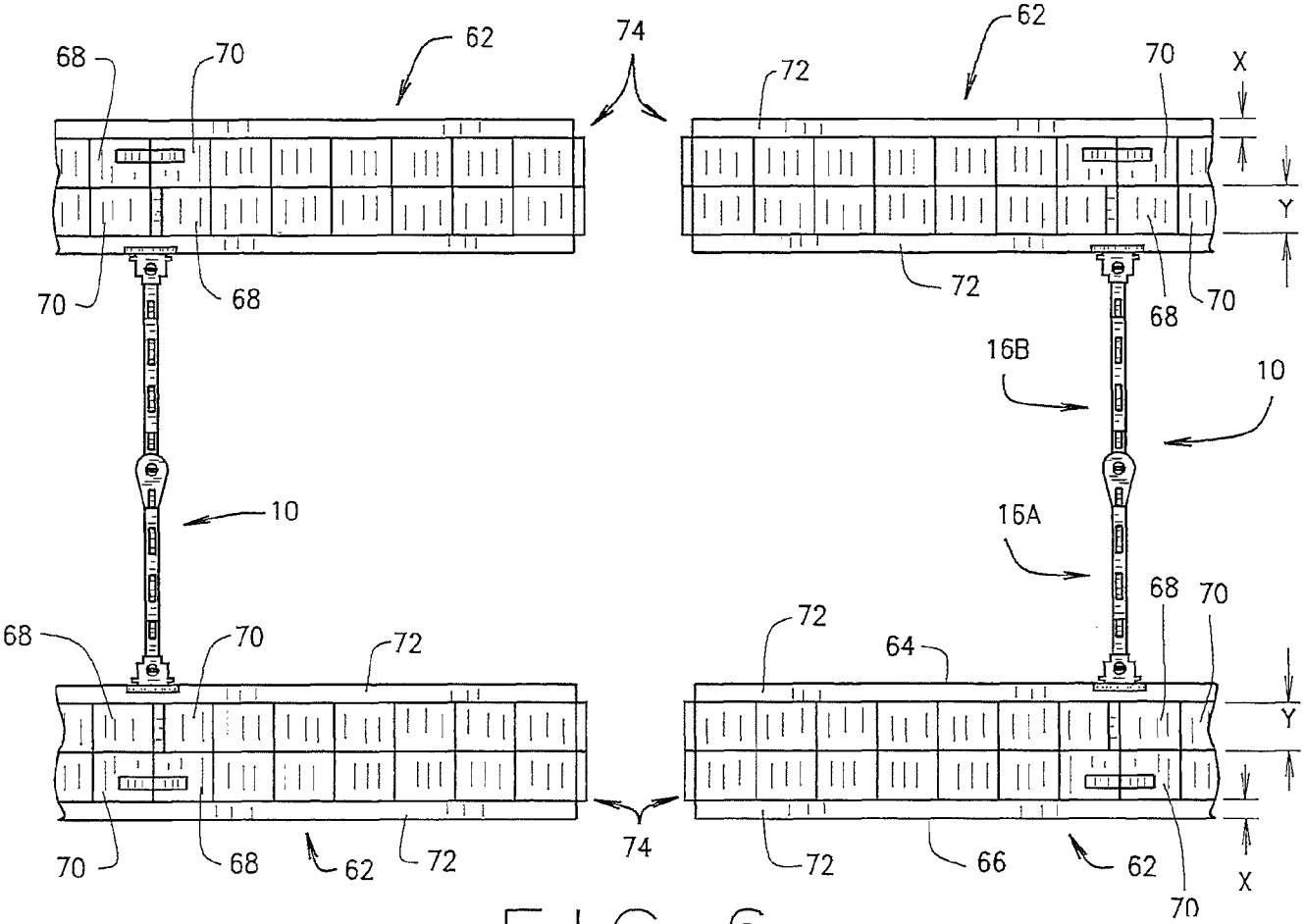
FIG. 6 is a partial top plan form view of two adjacent ICF blocks of FIG. 4.

An array of alternating teeth 68 and sockets 70 are formed in opposing horizontal longitudinal edges of the ICF panel members 62 as is best illustrated in FIGS. 4 and 6. In a preferred embodiment, the array includes a double median row of alternating teeth 68 and sockets 70, the rows being offset from each other by the distance of one side of one tooth 68. Since the array of alternating teeth and sockets are centrally located on the respective opposed horizontal longitudinal edges of the panel members 62, a substantially flat co-planar edge or surface 72 is established on each opposite side of the array of teeth and sockets, the substantially flat planar surfaces 72 extending substantially the full length of the opposing horizontal top and bottom longitudinal edges of each panel 62 on each opposite side of the array of teeth and sockets as best illustrated in FIGS. 4 and 6. These substantially flat surfaces 72 include no trap spaces and make for a stronger and tighter seal between interlocking surfaces thereby substantially improving the overall strength and stability of a wall structure constructed using the present blocks 60. The width of each of the planar surfaces 72 can be equal to or greater than the width of any one of the alternating teeth 68 or sockets 70, although a shorter width can likewise by used. Ina preferred embodiment, the width "X" of each of the planar surfaces 72 is equal to or greater than one half (½) the width "Y" of one tooth 68 as best illustrated in FIG. 6. The substantially flat planar surfaces 72 likewise facilitate a cleaner outside exterior wall surface and reduce the amount of wall preparation work that is typically needed with certain exterior finish applications.

In addition, as best seen in FIGS. 4 and 6, the teeth 68 associated with one of the opposed horizontal longitudinal edges of the panels 62 are vertically aligned with the sockets 70 associated with the other of the opposed horizontal longitudinal edges of the panels 62, and the sockets 70 associated with one of the opposed horizontal longitudinal edges of the panels 62 are vertically aligned with the teeth 68 associated with the other of the opposed horizontal longitudinal edges of the panels 62. It is also important to recognize that the pair of panels 62 are positioned relative to each other such that the teeth 68 associated with the row of alternating teeth 68 and sockets 70 located closest to the outer surface 66 of one of the pair of panels 62 forming the block 60 are horizontally aligned with the sockets 70 associated with the row of alternating teeth and sockets located closest to the outer surface 66 of the other of the pair of panels 62 forming the block 60, and the teeth 68 associated with the row of alternating teeth 68 and sockets 70 located closest to the inner surface 64 of one of the pair of panels 62 forming a block 60 are horizontally aligned with the sockets 70 associated with the row of alternating teeth and sockets located adjacent the inner surface 64 of the other of the pair of panels 62 forming the block 60. Employing such a tooth and socket configuration along opposing longitudinal edges of a given ICF panel 62 yields a panel having opposing longitudinal edges capable of engageably receiving either opposing longitudinal edge of an adjacent, similarly configured, panel 62 of a straight block 60 or other block configuration in a stacked fashion. As a result, a block 60 employing a pair of panel members 62 each having opposed longitudinal edges of this configuration can be engageably stacked upon and below adjacent blocks 60 of substantially the same configuration, regardless of the vertical and/or horizontal orientation of the panels 62 around their respective longitudinal axes.

The space or socket 70 formed between adjacent teeth 68 is of such dimensions as to enable the socket 70 to snuggly and engageably receive a tooth 68 therewithin. Advantageously, the teeth 68 associated with one block 60 will overlap with the teeth of a stacked block 60 when the teeth 68 are positioned within corresponding sockets 70 a total of at least one inch. This overlapping arrangement is greater than the overlapping teeth configuration presently utilized in the marketplace and will further improve the strength of the interlocking teeth friction fit of the stacked blocks. In addition, a bevel (not shown) can be formed along at least a portion of the perimeter of the distal end of each tooth 68 to serve as a guide to direct the tooth 68 within a corresponding socket 70. In one embodiment (not shown), the bevel can be formed along and throughout the entire perimeter of the distal end. In another embodiment (not shown), the bevel can be formed along only a portion of the perimeter of the distal end such as along the two opposing sides of the teeth 68 that will engage the teeth 68 on either side of the corresponding socket 70. In this regard, it is recognized and anticipated that the length, width, height and configuration of the respective teeth 68 and sockets 70 can vary depending upon the particular application. The greater the lateral cross-sectional area of a tooth 68, the greater the strength of the tooth and the interlocking connection between respective blocks 60.

The opposing vertical ends 74 of the panels 62 may likewise include an array of alternating teeth 76 and sockets 78 formed therein as best illustrated in FIGS. 5, 8, 11A, 11B and 17 for engageably receiving corresponding teeth 76 and sockets 78 associated with either opposing vertical end of a similarly configured panel 62 when two such panels are positioned in a horizontally adjacent configuration. This configuration again yields ICF blocks that can be horizontally locked together regardless of the horizontal orientation of the vertical ends of such blocks. In one embodiment, the array includes at least one row of alternating teeth 76 and sockets 78. Here again, the location of the teeth 76 associated with one of the vertical longitudinal edges of the panels 62 corresponds with the location of the sockets 78 associated with the other of the vertical longitudinal edges of the panels 62, and the location of the sockets 78 associated with one of the vertical longitudinal edges of the panels 62 corresponds with the location of the teeth 76 associated with the other of the vertical longitudinal edges of the panels 62. In another embodiment, the array can include a double median row of alternating teeth 76 and sockets 78 positioned and arranged as specifically shown in FIG. 17 similar to the arrangement of teeth 68 and sockets 70 discussed above with respect to the opposed horizontal longitudinal edges of the panel members 62. Also, the vertical ends 74 of each panel 62 may likewise include substantially flat co-planar edges 79 similar to edges 72 discussed above. Interlocking of adjacent horizontally positioned blocks 60 are likewise further achieved by staggering the vertical placement of each row of blocks 60 such that one block 60 spans the interconnection of two horizontally adjacent blocks 60 located in the row therebelow.

As best illustrated in FIGS. 1 and 4, the fastening plate offset overlapping extension members 44A and 44B extend into the teeth area associated with the opposed horizontal longitudinal edges of each respective ICF panel 62 to provide an additional locking feature when ICF blocks are stacked on top of each other. As more clearly illustrated in the cutaway view of FIG. 7, the extension member 44A extends into and is at least partially encapsulated by the corresponding tooth 68 and its upper surface 45 lies in a plane substantially flush with or slightly below the upper top surface of the tooth 68. In similar respect, the side surface 47 of extension member 44A lies substantially flush with the side surface of the tooth 68 and is exposed into the adjacent socket 70. As a result, the teeth or gripping means 46 associated with the surface 47 of the fastening plate overlapping extension member 44A is likewise exposed to the adjacent open socket 70. The encapsulation of fastening plate overlapping extension member 44B into a corresponding tooth 68 associated with the opposite horizontal longitudinal edge of a particular ICF panel 62 is similarly configured such that the gripping means 46 associated therewith is similarly exposed to the adjacent socket 70. As a result, since the tie members 10 associated with similarly constructed ICF blocks 60 are positioned and located at the same longitudinal locations along the length of each respective block 60, the plurality of tie members 10 associated with one block 60 will align vertically with the plurality of tie members 10 associated with another block 60 vertically stacked thereabove. Since extension member 44A is a mirror image of and is offset to one side of the fastening plate 18 as compared to overlapping extension member 44B, when two similarly constructed blocks 60 are vertically engaged, the tooth 68 associated with one block panel 62 at least partially encapsulating the fastening plate overlapping extension member 44B will be inserted into the socket 70 positioned adjacent to the tooth 68 at least partially encapsulating the fastening plate overlapping extension member 44A associated with the other block panel. This will happen at each tie member location along the length of the respective blocks 60. As such, the teeth or gripping means 46 associated with the respective overlapping fastening plate extension members 44A and 44B will overlap with each other and align themselves for engagement with the respective sockets 70 when two ICF blocks 60 are joined. This integrated locking feature 46 associated with each respective extension member 44A and 44B will therefore create a positive connection between the stackable tie members 10 at each tie location. This functions as still a further locking feature when similarly constructed blocks 60 are stacked on top of each other. Even in a staggered arrangement from one row of blocks 60 to another row of blocks 60, the position and location of the respective tie members 10 are easily identified as well as the overlapping extension members 44A and 44B such that a worker can easily align the respective tie members 10 associated with vertically stacked but offset blocks 60. FIG. 8 shows the interconnection between the fastening plate overlapping extension members 44A and 44B when two similarly constructed blocks 60 are vertically stacked one on top of the other.

Figure 9:
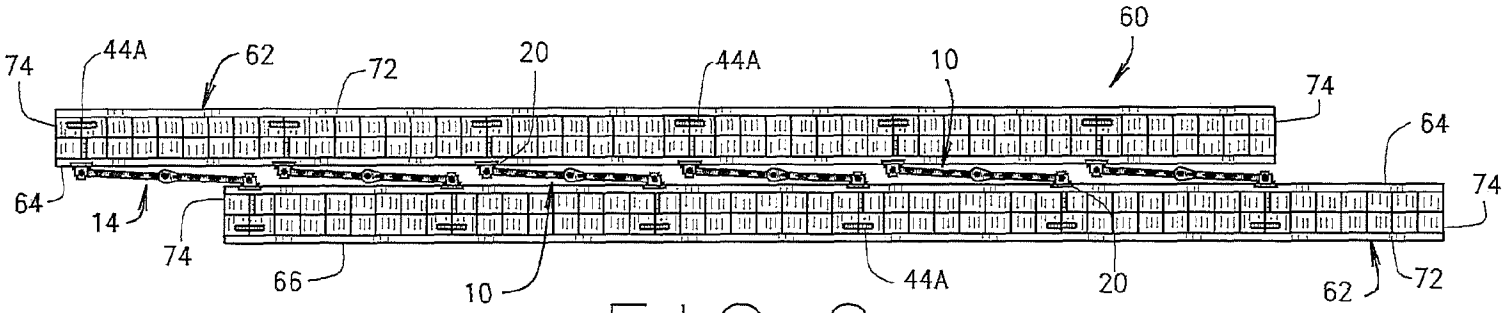
FIG. 9 is a top plan form view of the ICF block of FIG. 4 shown in its folded, collapsed position.

FIG. 9 shows a block 60 positioned in its folded position for packaging, storage, shipping, inventory, site storage and/or site staging. Since the tie members 10 are pivotally attached to the respective ICF panels 62 at their respective shut-off plates 20 and since the respective connection link members 16 are likewise pivotally connected to each other, this three hinged configuration allows each respective tie member 10 associated with each respective block 60 to be folded as illustrated in FIG. 9. Because the hinge pin members 34 are in alignment with each other as best illustrated in FIG. 3, the ICF panels 62 associated with each respective block 60 will not fold in perfect alignment with each other. Instead, as illustrated in FIG. 9, the opposed vertical ends 74 of the panels 62 comprising each respective block 60 are offset from each other. Nevertheless, even with this offset arrangement, this folding capability saves storage space, packing space, shipping space, and inventory space as well as costs associated therewith. It also reduces the amount of on-site storage room needed for storing blocks for a particular project and it likewise reduces the staging costs on larger multi-story structures.

It is also recognized and anticipated that the same offset folding capability can be achieved with a double hinge arrangement by merely hinging a substantially straight, one-piece web member between the respective side wall bracket hinge members 24. In this regard, the pair of connection link members 16 can be formed into a single, one-piece member having only hinge members 28 associated with the opposite end portions thereof for cooperative engagement with the hinge members 24 associated with the respective shut-off plates 20. Other double hinge configurations are likewise possible and will achieve the same offset folding configuration as illustrated in FIG. 9.

Use of the third hinge means located between the respective connection link members 16 in a straight line configuration as illustrated in FIG. 3 likewise serves a manufacturing function. The ability of tie member 10 to fold in three places, namely, in the middle and adjacent the inner surface 64 of each respective panel 62 serves as a prerequisite to being able to efficiently and economically offer a modular ICF system, and this triple hinged folding feature likewise provides the ability to redesign the ICF tools in a way that allows more than one size of ICF block to be made in each tool as is more fully discussed in Applicant's co-pending application, which disclosure is incorporated herein by reference.

Due to the high capital costs required to make ICF plastic injection tie tools as well as the ICF block tools in multiple heights and multiple widths, companies have not been able to offer a more modular system that offers a standard line of ICF blocks in multiple heights. The basic structure of the present tie member 10 in conjunction with a new set of innovative tooling designs and manufacturing processes covered in Applicant's co-pending application, the disclosure of which is incorporated herewith, will allow a company to efficiently and more cost-effectively offer an improved ICF product line in multiple heights and widths. As best illustrated in FIG. 5, the present tie member 10 illustrated therein can be made in a predetermined height such as, for example, a 6-inch height. As a result, a block 60 incorporating a 6-inch high plurality of tie members 10 will yield a 6-inch tall ICF block such as the block 60 illustrated in FIG. 5. Based upon the predetermined height of a single tie member 10, a plurality of ICF blocks 60 having different block heights can be easily fabricated using the same tie member 10 in a stacked arrangement. In other words, each ICF block height will be a multiple of the shortest block height, or a multiple of the predetermined height of the tie member 10. It is also recognized that a single pre-selected block height can be stacked one on top of the other to achieve a desired block height based upon multiples of the pre-selected block height.

Figure 10:
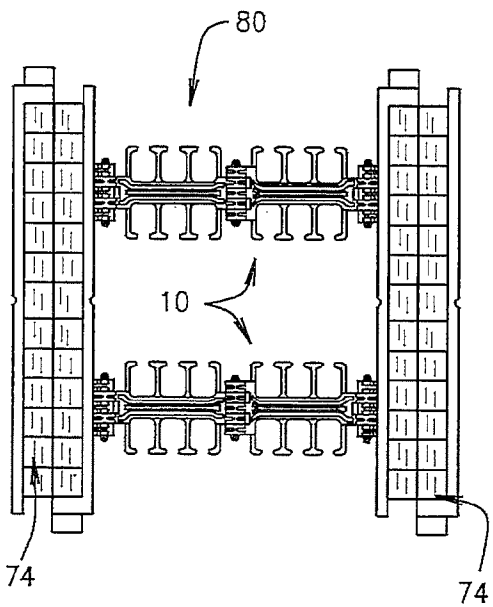
FIG. 10 is an end elevational view of an ICF block formed by using two of the tie members of FIG. 1 vertically stacked one on top of the other for producing a block having twice the height of the ICF block illustrated in FIG. 5.

As best illustrated in FIG. 10, a pair of tie members 10 are vertically stacked on top of each other at each spaced tie location along the length of the block thereby producing a block 80 twice the height of a block 60 which utilizes just a single plurality of tie members 10. If, for example, the height of a single tie member 10 is six inches, the block 80 in FIG. 10 will be 12 inches high. In similar fashion, if three tie members 10 are vertically stacked one on top of the other at each tie location along the length of the block 82 illustrated in FIGS. 11A and 11B, an ICF block having an 18-inch height will be produced. Still further, a 24-inch ICF block height will require the stacking of 4 of the present 6-inch tie members 10 at each tie location along the length of the block. As a result, without changing the size and shape of tie member 10, and without requiring additional ICF tie tools, a plurality of ICF blocks can be made using the same tie member. In this regard, the integrated locking feature 46 associated with fastening plate extension members 44A and 44B facilitate the stacking of the present tie members 10 in the ICF block tool cavity. This stacking capability is also illustrated in the partial cutaway view of FIG. 11B where the engagement of fastening plate overlapping extension members 44A and 44B is more clearly seen. ICF block tooling designed to accept the stacking of the individual tie members 10 is disclosed in Applicant's co-pending application, the disclosure of which is incorporated herein by reference. As a result, using just the tie member 10, any plurality of ICF block heights based upon a multiple of the height of tie member 10 can be easily, quickly, and cost effectively produced.

In similar fashion, the same plurality of ICF block heights based upon any multiple of the height of the tie member 10 can likewise be made in a plurality of different widths. The modularity of the present tie member 10 enables the width of a particular ICF block to be easily changed by merely changing the overall length of the respective pair of connection link members 16 forming the web portion 14. The shape, construction and fabrication of the respective side wall brackets 12 will remain the same and the pivotal connection arrangement between the shut-off plate 20 and a corresponding connection link member 16 will likewise remain the same. In fact, the design and shape of the respective connection link members 16 will remain the same, the only difference being its overall length. As a result, only ICF plastic injection tie tools forming the respective connection link members 16 need be changed in order to produce multiple width tie members. The ICF plastic injection tie tools for forming the respective side wall brackets 12 will remain the same. Only the length of the connection link members 16 need be changed in order to change the width of a particular ICF block such as any one of the blocks 60, 80 or 82. As a result, all of the present ICF blocks can be made in multiple heights and multiple widths by using the same ICF plastic injection tie tools for the side wall brackets 12, the pin members 34, and the various ICF panel heights using a minimum number of ICF block tools as explained in Applicant's co-pending application.

Figure 11A:
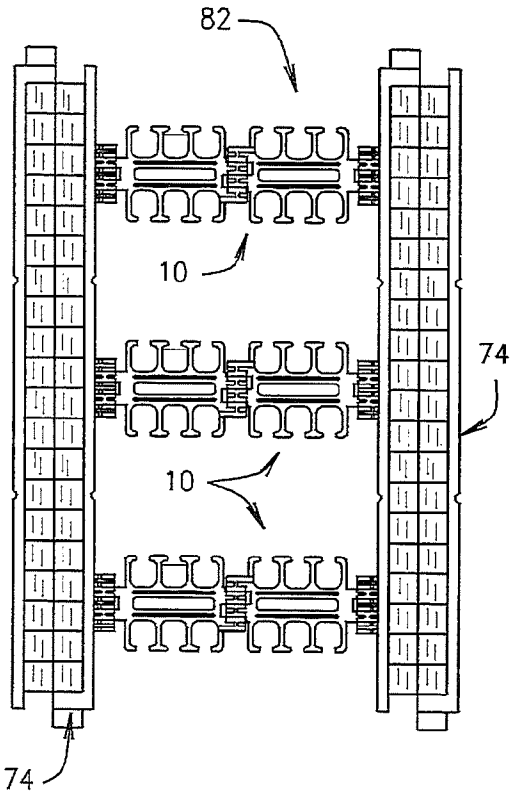
FIG. 11A is an end elevational view of an ICF block formed by using three of the tie members of FIG. 1 vertically stacked one on top of the other for producing a block three times the height of the ICF block of FIG. 5.
Figure 11B:
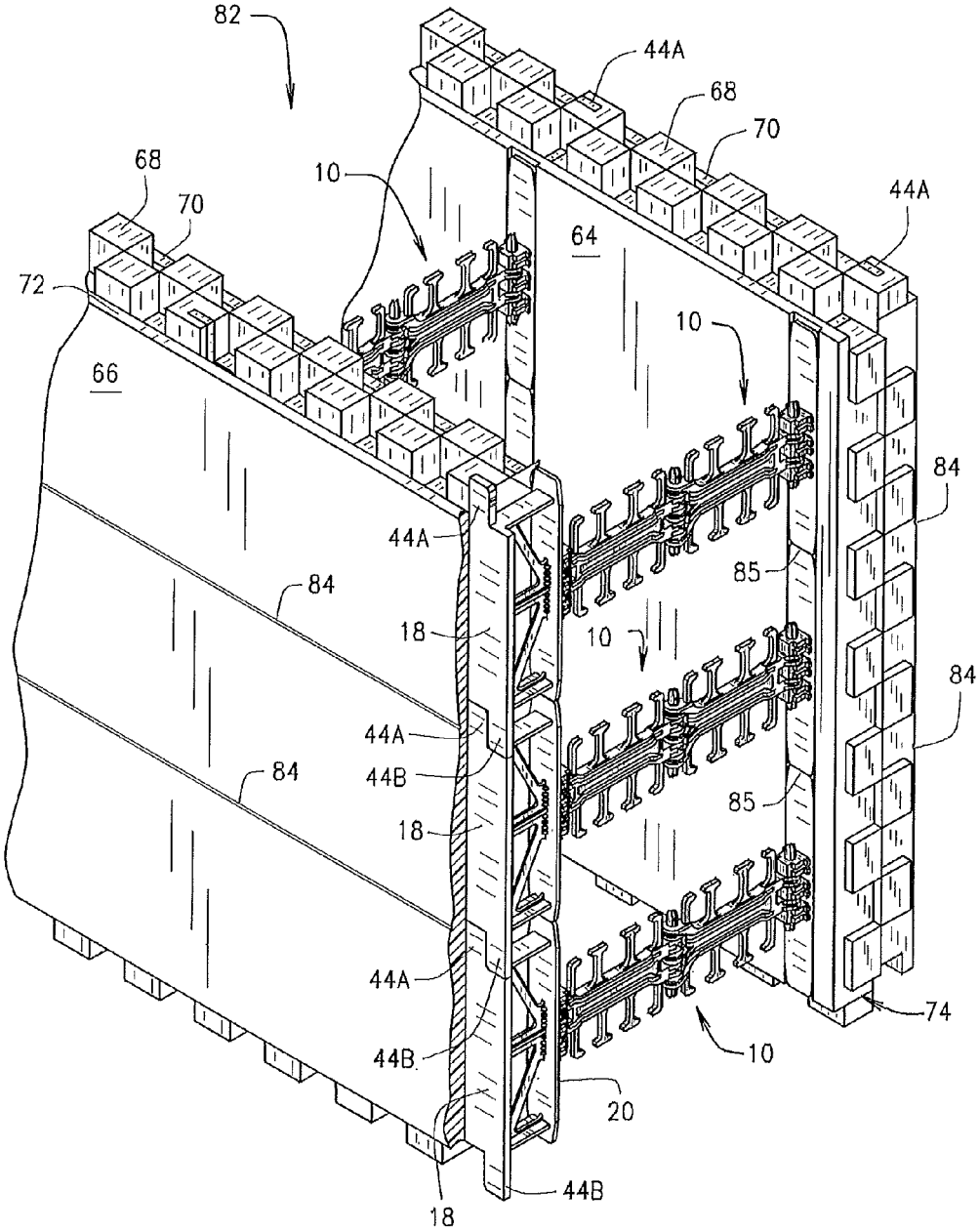
FIG. 11B is a partial perspective view of the ICF block of FIG. 11A showing a partial cut-away view of the vertically stacked engagement of the tie members of FIG. 1.

Still further, the modularity of the present tie members 10 also facilitates the creation of a new modular ICF block system which is now based on a common pre-determined interval of height based upon the height of the tie member 10. This modular capability will likewise enable heights based upon any multiple of the present tie member height to be severed or cut laterally at a plurality of different locations between the respective rows of stacked tie members 10 depending upon the height of the particular ICF block. For example, an 18-inch tall ICF block comprised by stacking three 6-inch tie members 10 vertically during the formation of the block as illustrated in FIGS. 11A and 11B will now be able to be cut on-site at both the ⅓ and ⅔ block positions reducing the amount of waste created. An ICF modular block system utilizing 6-inch, 12-inch, 18 and 24-inch block heights will now allow a designer to design a wall in any one foot or half foot increments because the present ICF system will be able to hit any such height. Utilizing the 6-inch height as the standard or basic tie member 10 height also facilitates some of the tooling and manufacturing processes discussed in Applicant's co-pending application. In similar fashion, a 24-inch ICF block height can be cut on-site at the ¼, ½, and ¾ block positions. In this regard, the exterior surface 66 of each panel forming ICF blocks 80 and 82, or any other panel height, can include a mark or other indicator 84 along its longitudinal axis at the appropriate locations for severing as best illustrated in FIG. 11B. These marks or indicators aid in accurately severing a block laterally at the appropriate location between a pair of stacked tie members 10. Cutting the ICF block along any one of the indicators 84 will sever the block between the two joined shut-off plates 20 associated with adjacent tie members 10 such as at the location 85 illustrated in FIG. 11B. Importantly, each of the resulting severed block portions will possess at least one substantially intact tie member 10 subsequently centered in the middle of each respective severed block portion.

Still further, as best illustrated in FIG. 11B, when more than two of the present tie members are vertically stacked at a plurality of spaced locations along the length of the ICF block to establish the overall height of the ICF block, each intermediate tie member 10 such as intermediate tie member 10I in the plurality of vertically stacked tie members has its opposed fastening plate extension portions 44A and 44B positioned in overlapping relationship with the fastening plate extension portion associated with an adjacent tie member, even though such extension portions 44A and 44B are embedded within the respective opposed panel members 62. In addition, the engaging members 46 associated with overlapping extension members 44A and 44B of the intermediate tie member 10I are likewise mated and engaged while embedded within the respective opposed panel members 62. This additional joinder promotes strength and stability regardless of the number of tie members 10 vertically stacked along the length of the panel members 62 to achieve a particular ICF block height.

Still further, in another aspect of the present invention, a wide plurality of ICF block heights can be achieved by making at least two different predetermined block heights each utilizing a single row of spaced apart tie members 10 extending along the length of each respective block. For example, referring again to FIG. 5, a plurality of blocks 60 could be made incorporating a 6-inch high plurality of tie members 10 which will yield a 6-inch tall ICF block, and a plurality of blocks 60 could also be made incorporating an 8-inch high plurality of tie members 10 which will yield an 8-inch tall ICF block. Using a combination of 6-inch and 8-inch tall ICF blocks, all usable heights except for a 10-inch tall ICF block can be achieved by simply stacking one or more of the 6-inch tall and/or 8-inch tall ICF blocks one upon the other to achieve the overall desired block height. For example, interconnecting two 6-inch tall ICF blocks will yield a 12-inch tall ICF block; interconnecting a 6-inch tall ICF block with an 8-inch tall ICF block will yield a 14-inch tall ICF block; interconnecting two 8-inch tall ICF blocks will yield a 16-inch tall ICF block; interconnecting three 6-inch tall ICF blocks will yield an 18-inch tall ICF block; interconnecting two 6-inch tall ICF blocks and an 8-inch tall ICF block will yield a 20-inch tall ICF block; interconnecting two 8-inch tall ICF blocks and a 6-inch tall ICF block will yield a 22-inch tall ICF block; interconnecting four 6-inch tall ICF blocks will yield a 24-inch tall ICF block; interconnecting three 6-inch tall ICF blocks and an 8-inch tall ICF block will yield a 26-inch tall ICF block; interconnecting two 8-inch tall ICF blocks and two 6-inch tall ICF blocks will yield a 28-inch tall ICF block, and so forth. Due to the plurality of locking mechanisms associated with the present panel members 62 and blocks such as the blocks 60 including the array of alternating teeth 68 and sockets 70 formed thereon, the overlapping fastening plate extension portions 44A and 44B associated with the present panel members and blocks, and the additional interlocking mechanisms 120 associated with the top portion of each respective tie member 108 as will be hereinafter further explained with reference to FIGS. 12-16, stacking of the present ICF blocks as well as the stacking of the present tie members 10 and 108 yields a strong, stable block regardless of how many 6-inch tall and/or 8-inch tall ICF blocks are vertically stacked one upon the other. As a result, the plurality of ICF block heights can likewise be easily achieved based upon combining any one or more of a 6-inch tall ICF block and/or an 8-inch tall ICF block. This substantially reduces tooling requirements and eliminates the need to stack a plurality of the present tie members 10 in an ICF block tool cavity as explained in Applicant's co-pending application. Instead of stacking the present tie members 10 and/or 108 in a cavity mold to form a desired block height, a plurality of 6-inch tall ICF blocks and/or 8-inch tall ICF blocks can be stacked in order to achieve all usable and desirable heights except for a 10-inch tall ICF block. This stacking can occur on site or can be accomplished prior to transportation of the ICF blocks to a building site in order to expedite construction. In similar fashion, the same plurality of ICF block heights based upon combining any plurality of 6-inch tall ICF blocks and/or 8-inch tall ICF blocks can likewise be made in a plurality of different widths as previously explained by merely changing the overall length of the respective pair of connection link members 16A and 16B forming the web portion 14.

Figure 12:
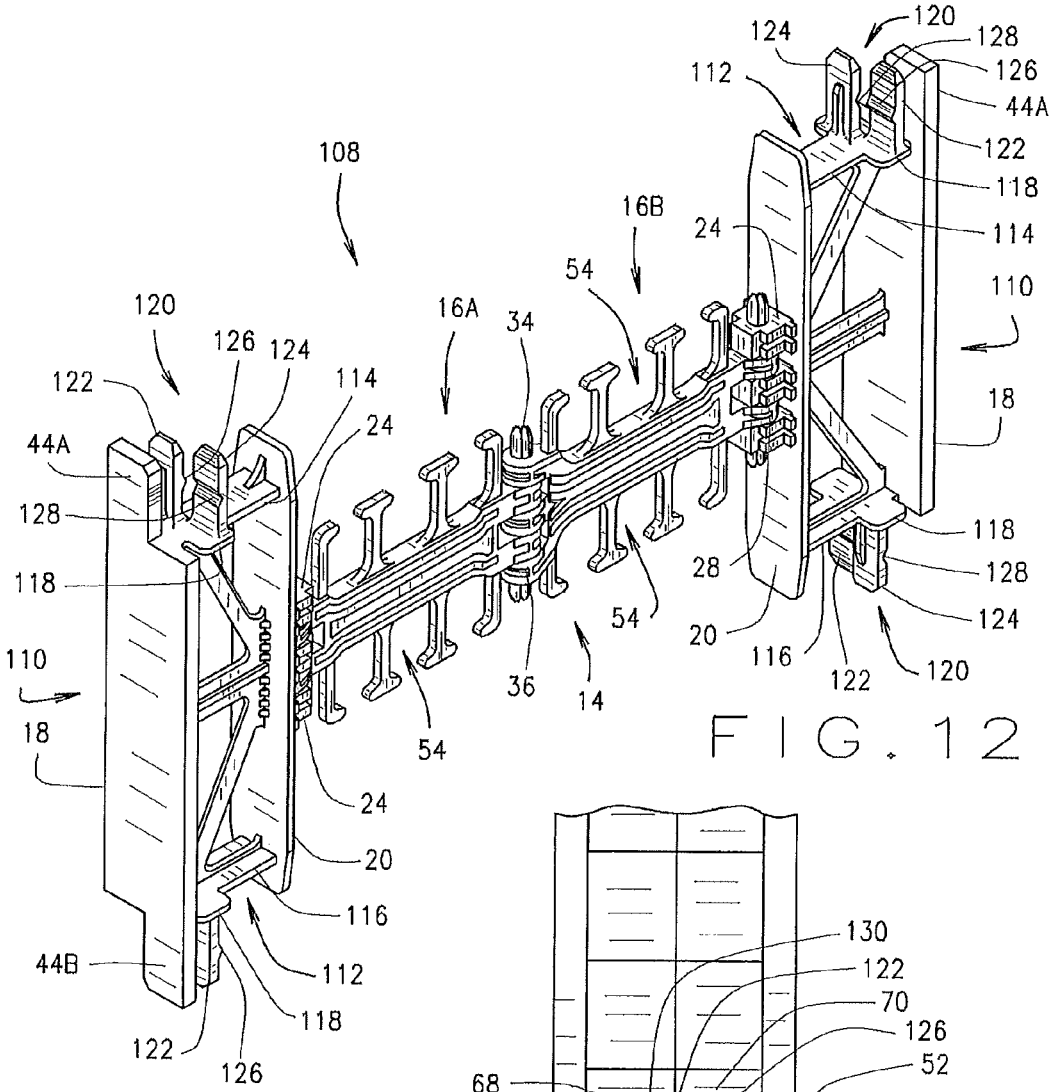
FIG. 12 is a perspective view of another embodiment of a stackable/foldable tie member constructed according to the teachings of the present invention.

In still another aspect of the present invention, FIGS. 12-16 illustrate still another embodiment of the present tie member, namely, tie member 108, constructed in accordance with the teachings of the present invention. The tie member 108 is substantially identical to tie member 10 except that tie member 108 includes an additional interlocking mechanism associated with the top and bottom portions of each respective side wall bracket member as will be hereinafter further explained. More particularly, tie member 108 includes a pair of opposed side wall bracket members 110 which are substantially identical to side wall bracket members 12 in that they each include a fastening plate 18, a spaced apart shut-off plate 20, and a plurality of bridging members connected therebetween forming a substantially similar truss structure 112 therebetween. The truss structure 112 is substantially identical to truss structure 22 except that the top and bottom bridging members 114 and 116 each include a platform member 118 which is sized and shaped to hold the interlocking mechanism 120 as best illustrated in FIGS. 12 and 14. Interlocking mechanism 120 includes a pair of first and second interlocking members or finger extensions 122 and 124 positioned and located between fastening plate 18 and shut-off plate 20, first interlocking member 122 having a projection 126 associated therewith and second interlocking member 124 having a groove 128 associated therewith as best illustrated in FIGS. 12 and 14. The pair of first and second interlocking members 122 and 124 are laterally offset and staggered from each other as best illustrated in FIG. 14, the interlocking mechanisms 120 associated with the top bridging member 114 associated with a respective pair of side wall bracket members 110 being cooperatively engageable with the interlocking mechanisms 120 associated with the lower bridging member 116 associated with a corresponding pair of side wall bracket members 110 when a pair of similar tie members 108 are vertically stacked one on top of the other as previously explained with respect to tie member 10. In this regard, the interlocking mechanism 120 associated with the top portion of each respective side wall bracket member 110 is a mirror image of the interlocking mechanism 120 associated with the lower opposite end portion of each respective side wall bracket member 110 as best illustrated in FIGS. 12 and 13, and interlocking member or finger extension 122 is always positioned closest to and in longitudinal alignment with the fastening plate overlapping extension portions 44A and 44B associated with the fastening plate 18, whereas the second interlocking member or finger extension 124 is always positioned in a laterally offset arrangement relative to interlocking member 122 and further away from fastening plate member 18 as again best illustrated in FIGS. 12 and 14. This offset arrangement enables the projection 126 associated with the first interlocking member 122 associated with one end portion of each respective side wall bracket member 110 to cooperatively engage the groove 128 associated with the second interlocking member 124 associated with the opposite end portion of each respective side wall bracket 110 when two side wall brackets 110 are stacked one on top of the other. The interlocking mechanism 120 thereby provides a double snap lock feature associated with each respective side wall bracket member in addition to the overlapping engagement of the fastening plate extension portions 44A and 44B as previously explained. This additional interlocking mechanism 120 associated with the opposite end portions of each respective side wall bracket 110 allows any plurality of tie members 108 to be vertically stacked and interconnected one on top of the other to build any plurality of vertically stacked tie members 108 to achieve different ICF block heights such as ICF blocks 80 (FIG. 10) and 82 (FIG. 11A) discussed above. Just like tie member 10, tie member 108 can be used to form any plurality of ICF block heights based upon any multiple of the height of tie member 108.

Figure 15:
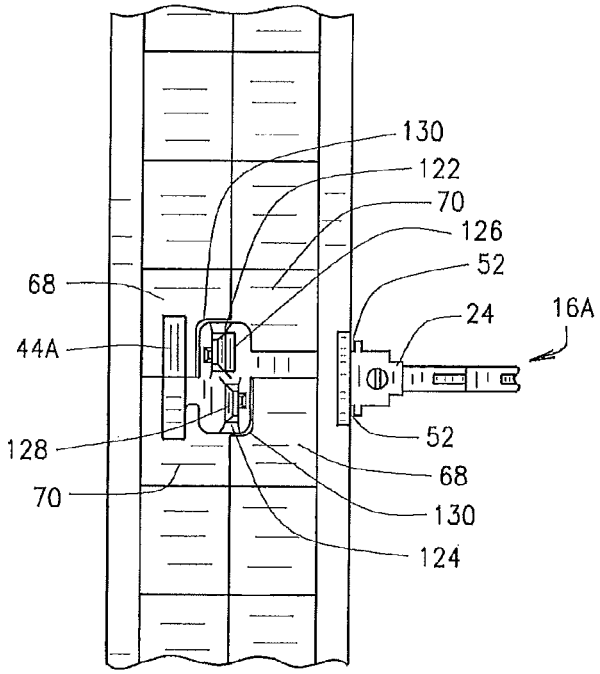
FIG. 15 is a partial top plan form view of a pre-constructed straight ICF form block of the present invention showing one of the side wall bracket members of the tie member of FIG. 12 encapsulated therewithin and showing the additional interlocking mechanism projecting into the interlocking teeth area associated with the ICF panel.
Figure 17:
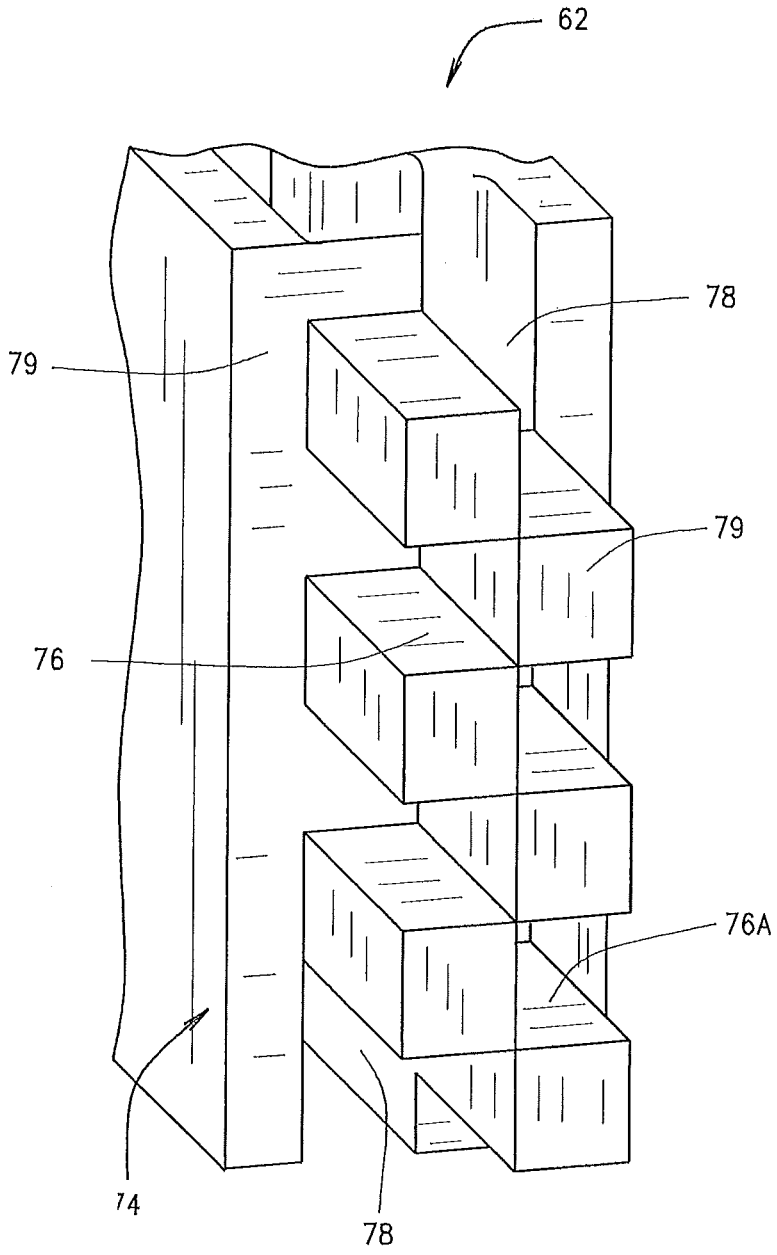
FIG. 17 is a partially enlarged perspective view of one embodiment of a tooth and socket arrangement associated with each opposed vertical end of the panels forming an ICF block.

Similar to the fastening plate offset overlapping extension members 44A and 44B, the interlocking mechanism 120 associated with the top and bottom portions of the pair of side wall bracket members 110 associated with the tie member 108 positioned adjacent the opposed horizontal longitudinal edges of each ICF panel forming a particular ICF block likewise extend into the teeth area associated with the opposed horizontal longitudinal edges of each respective ICF panel to provide an additional locking feature when ICF blocks are stacked on top of each other. As more clearly illustrated in FIG. 15, the offset interlocking members 122 and 124 extend into corresponding teeth 68 at the approximate center of the panel member. In this regard, the corresponding teeth 68 adapted to receive the first and second interlocking members 122 and 124 are offset from each other as shown in FIG. 15 and each respective tooth 68 has a corner portion removed therefrom forming a space or cavity 130 sufficient to receive the respective interlocking members 122 and 124. Also, since the respective teeth 68 adapted to receive the interlocking members 122 and 124 are positioned adjacent respective corresponding sockets 70, the projection 126 and the groove 128 associated with the interlocking members 122 and 124 are exposed to the adjacent sockets 70 and this likewise provides sufficient space for engaging a corresponding interlocking mechanism 120 associated with another vertically stacked side wall bracket member 110. As a result, when one ICF block is vertically arranged on top of a similarly constructed ICF block, the interlocking mechanisms 120 associated with the top portion of each respective tie member 108 associated with one of the ICF blocks will cooperatively engage and interconnect with the interlocking mechanisms 120 associated with the bottom portion of each respective side wall bracket member 110 associated with the plurality of tie members 108 in the other ICF block. Since the tie members 108 associated with similarly constructed ICF blocks are positioned and located at the same longitudinal locations along the length of each respective ICF block, the plurality of tie members 108 associated with one ICF block are aligned vertically with the plurality of tie members 108 associated with another ICF block vertically stacked thereabove.

Figure 19:
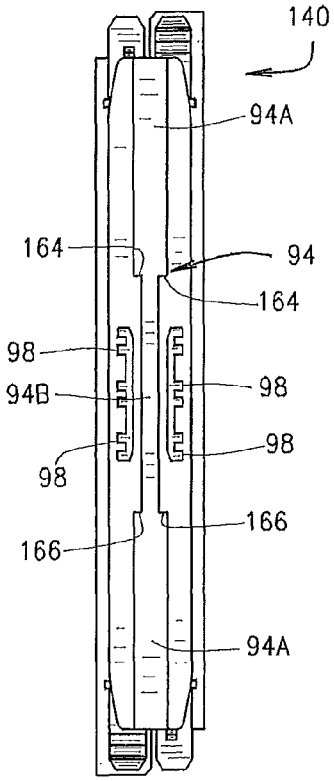
FIG. 19 is an end elevational view of one of the side wall bracket members illustrated in FIG. 18.

When two similarly constructed ICF blocks are vertically engaged, the interlocking members 122 and 124 associated with the horizontal longitudinal edge of each panel member forming one ICF block will have its corresponding projection 126 and groove 128 extending into an adjacent socket 70 and such interlocking members 122 and 124 will be inserted into the corresponding sockets 70 associated with the horizontal longitudinal edge of each panel member forming the other ICF block to which it is being attached. This engagement will happen at each tie member location along the length of the respective ICF blocks so joined. As such, the snap lock feature 120 associated with each respective tie member 108 at each opposed side wall bracket 110 will cooperatively engage when two ICF blocks are joined. This additional locking feature associated with each side wall bracket member 110 will therefore create a still further positive connection between the stackable tie members 108 at each tie location. This functions as still a further locking feature when similarly constructed ICF blocks are stacked on top of each other. This interlocking connection between two side wall bracket members 110 associated with similarly constructed and stacked ICF blocks is illustrated in FIG. 19. In this regard, it is recognized that the engagement of the projection 126 and groove 128 associated with corresponding first and second interlocking members 122 and 124 do not have to be flush with each other when engaged so long as the engagement achieves a connection. It is also further recognized and anticipated that any plurality of projections 126 and grooves 128 can be associated with interlocking members 122 and 124 as will be hereinafter further explained.

In all other respects, the tie member 108 is substantially identical to the tie member 10 in that it likewise includes similarly constructed shut-off plates 20 each including a plurality of spaced-apart projections 24 as previously explained for attaching to the web portion 14 which includes a pair of cooperatively engageable connection link members 16A and 16B as previously described with respect to FIG. 2. The connection link members 16A and 16B likewise include hinged projection members 28 and 36 for cooperatively engaging each other and the projections 24 associated with the shut-off plates 20 via pin members 34 as previously explained with respect to tie member 10. Importantly, each tie member 108 likewise includes a pair of corresponding tool engaging slots 52, each slot 52 being formed adjacent the respective shut-off plates 20 as previously explained. This enables the side wall bracket members 110 associated with each tie member 108 to be cooperatively held and secured within the ICF block forming tool as explained in Applicant's co-pending application. As a result, side wall bracket members 110 can be used in all of the same applications as side wall bracket member 12 associated with tie member 10.

Still further, it is also recognized and anticipated that the interlocking mechanism 120 associated with tie member 108 can be used in combination with the fastening plate overlapping extension portions 44A and 44B including in combination with the gripping means 46 associated with each respective extension member 44A and 44B. It is also recognized and anticipated that the interlocking mechanism 120 can likewise be utilized in combination with the fastening plate overlapping extension portions 44A and 44B without use of the gripping means 46 associated respectively therewith since the interlocking members 122 and 124 foam a positive double-snap locking arrangement between vertically stacked tie members 108 and between vertically stacked similarly constructed ICF blocks. Still further, it is recognized and anticipated that the interlocking mechanisms 120 can be used by themselves without utilizing the fastening plate overlapping extension portions 44A and 44B discussed above. In this regard, the side wall bracket members could be fashioned substantially identically to the side wall bracket members 110 except that the fastening plate extension members 44A and 44B can be removed and a substantially flat continuous fastening plate could be utilized in its stead. In such an embodiment, the interlocking mechanism 120 would provide the only positive interlocking connection between vertically stacked tie members and between similarly constructed ICF blocks. In all other respects, the tie member 108 functions substantially similarly to the tie member 10 including being pivotally foldable and collapsible as illustrated in FIG. 9 with respect to tie member 10, and the connection link members 16A and 16B associated with tie member 108 can likewise include any number of rebar seats 54 as previously explained.

Figure 18:
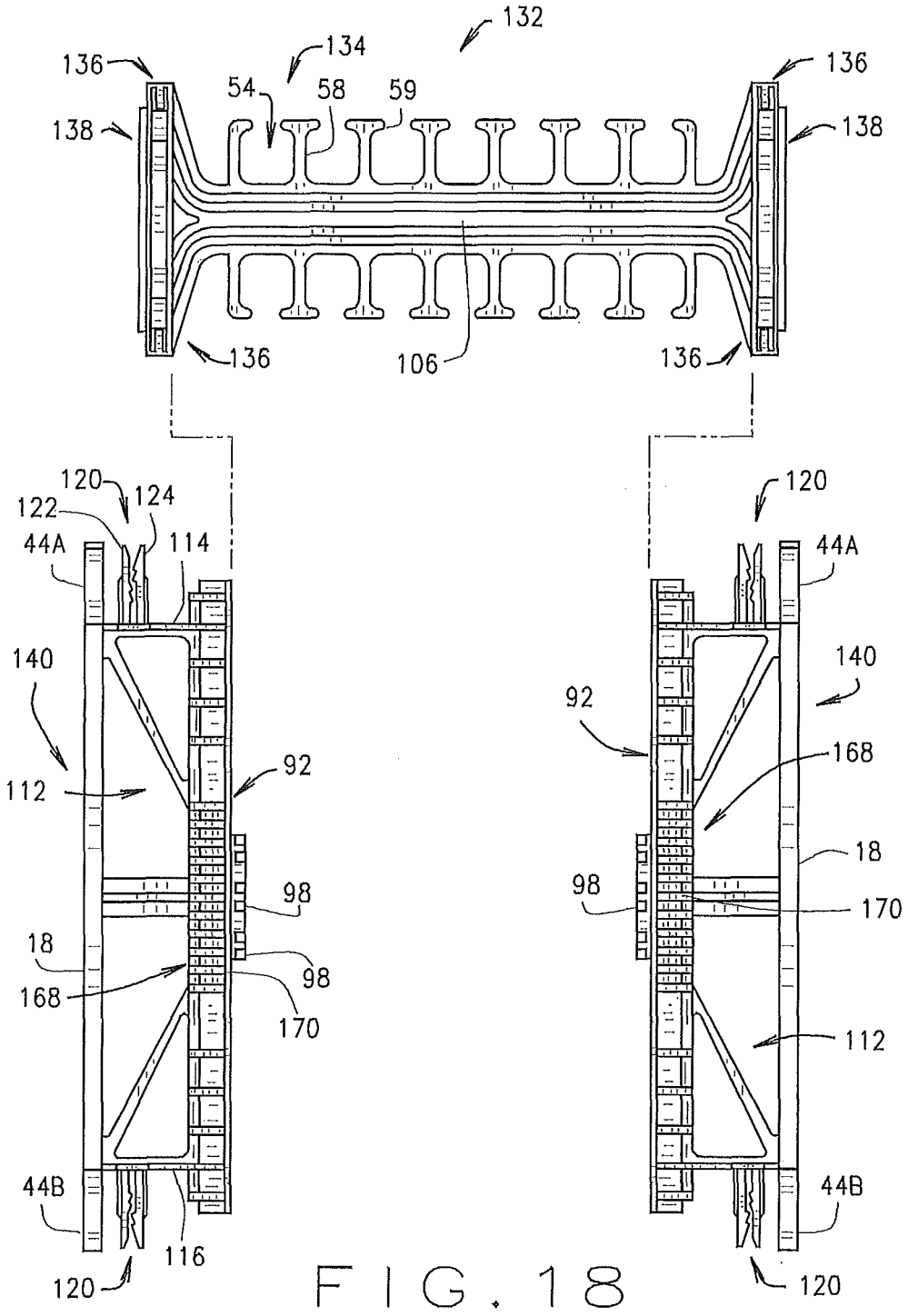
FIG. 18 is a perspective view of another embodiment of a field assembled tie member constructed according to the teachings of the present invention.
Figure 21:
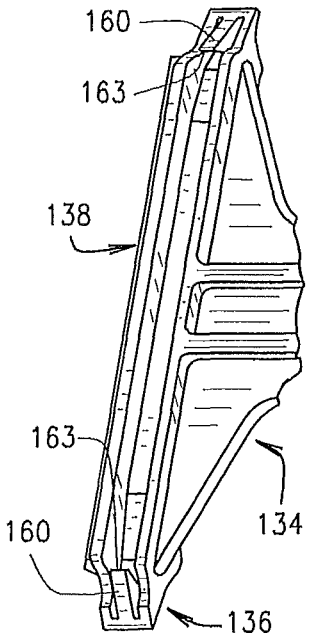
FIG. 21 is a partially enlarged perspective view of one of the opposed end portions of the web member illustrated in FIG. 18 showing the locking mechanism associated with each opposite end portion thereof.
Figure 22:
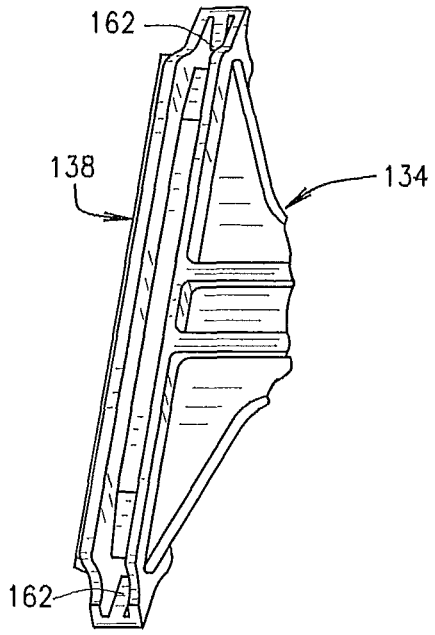
FIG. 22 is a partially enlarged perspective view similar to FIG. 21 showing the opposite side portion of the respective locking mechanisms associated with each opposite end portion of the field assembled web member.
Figure 23:
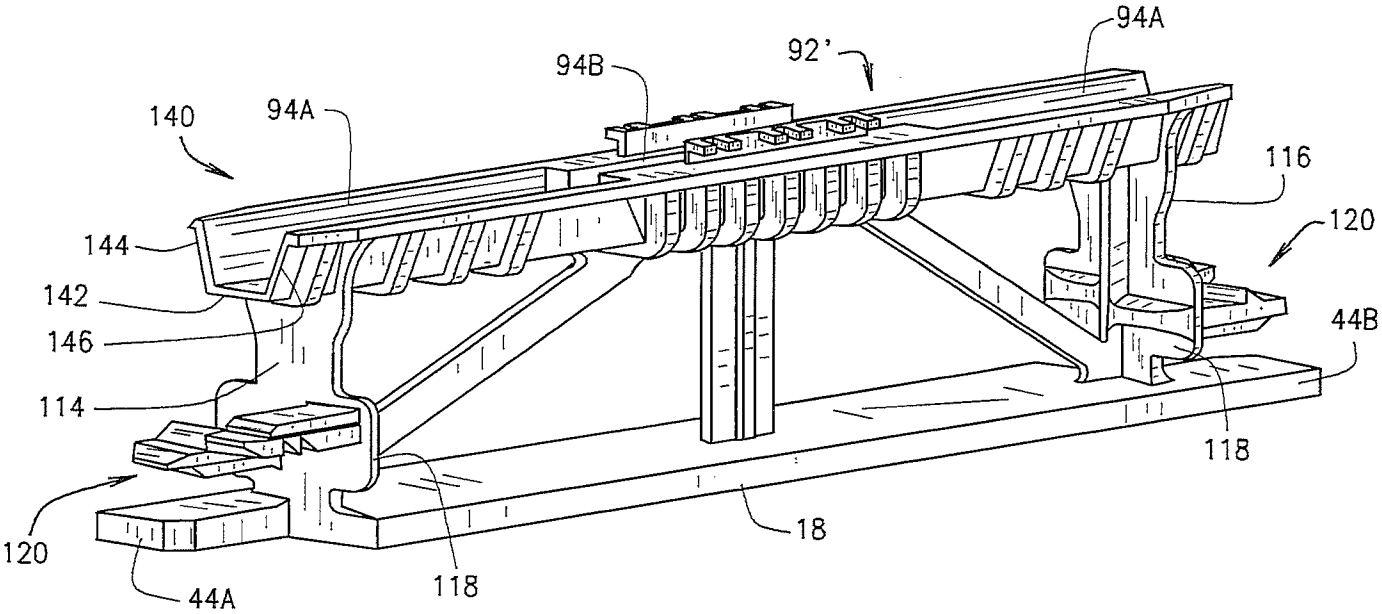
FIG. 23 is a perspective view of one of the side wall bracket members illustrated in FIGS. 18-20.

In still another aspect of the present invention, FIGS. 18-24 illustrate one embodiment of a field assembled modular tie member 132 constructed in accordance with the teachings of the present invention. The tie member 132 includes at least one snap-locked stop member 136 associated with at least the top portion of each respective end portion 138 associated with the web member 134 as well as an additional interlocking mechanism 120 as previously explained with respect to tie member 108. More particularly, tie member 132 includes a pair of opposed side wall brackets 140 separated by, and connected to, a center web member 134. Unlike web member 14, web member 134 is a single, one-piece member as best illustrated in FIG. 18 which is cooperatively engageable with the respective side wall bracket member 140, one of which is best illustrated in FIGS. 19 and 23, as will be hereinafter further explained. Side wall brackets 140 are substantially identical in structure to each other and are adapted to receive the web member 134 regardless of its width. Web member 134 includes at least one snap-locked stop member 136 associated with at least the top portion of each respective end portion 138. Tie member 132 likewise includes an additional interlocking mechanism 120 as previously explained with respect to tie member 108.

Each side wall bracket member 140 is substantially similar to the side wall bracket members 12 in that they likewise include the same fastening plate 18, a spaced apart shut-off plate 92 which is slightly different from shut-off plate 20, and the same identical plurality of bridging members connected therebetween forming substantially the same identical truss structure 112 therebetween. The fastening plate 18 likewise includes substantially identical overlapping extension end portions 44A and 44B positioned in offset relationship to each other at the respective opposite end portions thereof for allowing the respective tie members 132 to likewise cooperatively engage other similarly constructed tie members 132 which are stackably arranged one on top of the other as previously explained with respect to tie member 10. The extension members 44A and 44B may or may not include engaging members 46 as previously explained with respect to tie member 10. In all other respects, the side wall bracket member 140 components 18, 22, 44A, 44B are constructed, function and operate as previously explained with respect to the identical components associated with tie members 10 and 108.

The shut-off plate 92 associated with side wall bracket member 140 differs from shut-off plate 20 in that it does not include any hinge means such as the projections 24 associated with shut-off plate 20. Instead, shut-off plate 92 includes a slot 94 adapted to receive the correspondingly shaped opposed end portions 138 of the web member 134 when a respective end portion 138 is insertably positioned within the slot 94. In this regard, the web member 134 is slidably engageable with a pair of opposed side wall bracket members 140 when the bracket members 140 are each respectively encapsulated within an ICF panel member such as panel member 62. Each slot 94 includes an intermediate narrower slot portion 94B which is flanked on each opposite end thereof by a wider slot portion 94A as best shown in FIG. 22. Slot portion 94A is slightly larger than slot portion 94B so that the opposed end portions 136 of the web member 134 can be inserted into a particular pair of opposed side wall bracket members 140 regardless of their location in a particular ICF block structure including at any intermediate location when a particular ICF block includes two or more field assembled tie members 132. The wide slot portion 94A allows the opposed end portions 136 of each web member 134 to be easily inserted therein and then moved into engagement with slot portion 94B.

In this regard, the respective slot portions 94A are formed by side wall portions 142, 144 and 146 as best illustrated in FIG. 23. To further facilitate the insertion of the opposed end portions 138 of the web member 134 into the slot 94 at any intermediate location in a particular ICF block structure, the opposed side walls 144 and 146 forming the slot portion 94A are flared, tapered or angled outwardly away from each other as illustrated in FIG. 23. This tapering or angling of slot side walls 144 and 146 creates sloping or angularly related opposed side walls 144 and 146 forming the slot portion 94A which, in effect, provides for a truncated V-shaped slot portion which is wider in width at its outer terminal edge portions as compared to the slot width at a location which is opposite its outer terminal edge portions or adjacent wall portion 142 (FIG. 23). This truncated V-shaped slot portion further facilitates the easy insertion of the opposed end portions 138 of each web member 134 at any intermediate location when a particular ICF block includes two or more field assembled tie members 132 positioned in a vertically stacked arrangement.

Figure 20:
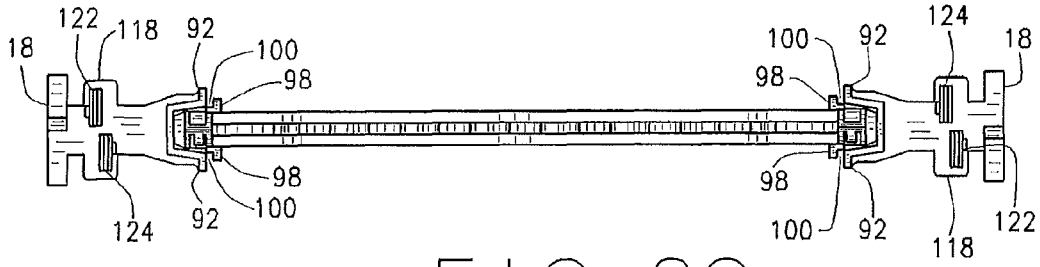
FIG. 20 is a top plan form view of the tie member illustrated in FIG. 21 in its assembled form.
Figure 25:
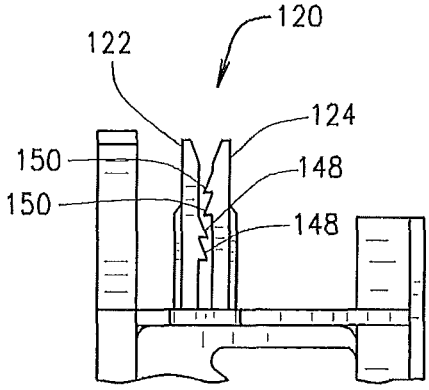
FIG. 25 is a partially enlarged side elevational view of one embodiment of the interlocking members associated with one end portion of the side wall bracket members illustrated in FIG. 18.

Each side wall bracket member 140 likewise includes a pair of interlocking mechanisms 120 as previously explained with respect to tie member 108. In this regard, the truss structure 112 of field assembled tie member 132 is substantially identical to truss structure 112 associated with foldable tie member 108 and includes top and bottom bridging members 114 and 116 which each include a platform member 118 which is sized and shaped to hold the interlocking mechanism 120 as best illustrated in FIGS. 20 and 23. Interlocking mechanism 120 includes a pair of first and second interlocking members or finger extensions 122 and 124 which are positioned and located in a laterally offset and staggered arrangement between fastening plate 18 and shut-off plate 92 as previously explained with respect to tie member 108. In the particular embodiment illustrated in FIGS. 18-20 and 25, the first interlocking member 122 includes a pair of projection members 148 and the second interlocking member 124 likewise includes a pair of projection members 150 as best illustrated in FIG. 25. This arrangement is slightly different from the interlocking mechanism 120 illustrated with respect to tie member 108 wherein the first interlocking member 122 includes a single projection member 126 and the second interlocking member 124 includes a corresponding groove 128 as best illustrated in FIGS. 12 and 15. As previously explained, it is recognized and anticipated that any plurality of projections and/or grooves can be associated with the interlocking members 122 and 124 in order to achieve an overlapping snap locked engagement between the respective members 122 and 124. In all other respects, the interlocking mechanism 120 associated with field assembled tie member 132 is substantially identical in function and operation to the interlocking mechanism 120 associated with tie member 108.

In this regard, the interlocking mechanisms 120 associated with the top bridging member 114 associated with a respective pair of side wall bracket members 140 are cooperatively engageable with the interlocking mechanisms 120 associated with the lower bridging member 116 associated with a corresponding pair of side wall bracket members 140 when a pair of similar tie members 132 are vertically stacked one on top of the other as previously explained with respect to tie member 108. The interlocking mechanism 120 associated with the top portion of each respective side wall bracket member 140 is a mirror image of the interlocking mechanism 120 associated with the lower opposite end portion of each respective side wall bracket member 140 as best illustrated in FIGS. 18 and 20. The laterally offset arrangement of the interlocking members 122 and 124 enables the projections 148 associated with the first interlocking member 122 to overlap and cooperatively engage with the projection members 150 associated with the second interlocking member 124 when two side wall bracket members 140 are stacked one on top of the other. In this regard, the engagement of the respective projections or teeth 148 and 150 associated with the corresponding first and second interlocking members 122 and 124 do not have to be flush with each other when engaged so long as the engagement achieves a connection therebetween.

Figure 26:
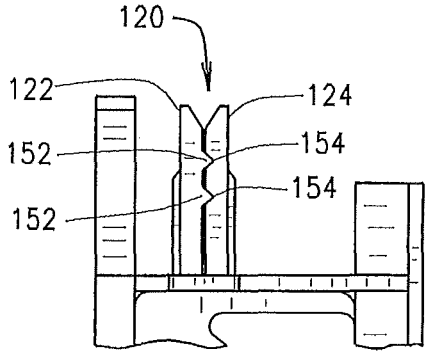
FIG. 26 is a partially enlarged side elevational view of another embodiment of the interlocking members illustrated in FIG. 25.
Figure 27:
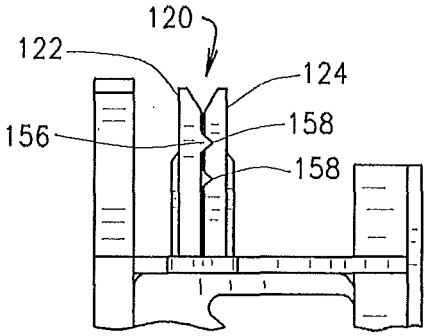
FIG. 27 is a partially enlarged side elevational view of still another embodiment of the interlocking members illustrated in FIGS. 25 and 26.

It is recognized that any plurality of teeth or projections 148 and 150 can be associated with the interlocking members 122 and 124 including a greater number of teeth associated with one interlocking member as compared to the other interlocking member. Still further, it is recognized and anticipated that interlocking member 122 can include a pair of teeth or projection members 152 for engaging a corresponding pair of grooves 154 associated with interlocking member 124 as best illustrated in FIG. 26. Still further, it is recognized and anticipated that interlocking member 122 may include a single tooth or projection member 156 and interlocking member 124 may include a pair of grooves 158 as best illustrated in FIG. 27. In this regard, it is recognized and anticipated that any number and any combination of teeth and grooves can be associated with the respective interlocking members 122 and 124 in order to achieve an overlapping snap lock between adjacent side wall bracket members 140. This includes teeth members engaging teeth members or teeth members engaging grooves as illustrated in FIGS. 25-27.

It is also recognized and anticipated that other cooperatively engagement means can be associated with interlocking members 122 and 124 in order to achieve a snap lock engagement therebetween. Still further, it is recognized that the position and location of the interlocking mechanism 120 between the fastening plate 18 and the shut-off plate 92' can be varied and that the interlocking mechanism 120 can be located at any position therebetween so long as the interlocking mechanism 120 associated with the tie members 108 and 132 positioned adjacent the opposed horizontal longitudinal edges of each ICF panel forming a particular ICF block likewise extends into the teeth area associated with the opposed horizontal longitudinal edges of each respective ICF panel such as illustrated in FIG. 15. The interlocking mechanism 120 functions and operates as previously described with respect to tie member 108 in order to provide either a primary or a secondary locking feature when ICF blocks are stacked on top of each other as previously explained.

Still further, as best illustrated in FIGS. 19 and 20, each of the side wall brackets 140, similar to sidewall brackets 12, likewise includes at least one set of opposed projections or fingers 98 associated with shut-off plate 92 on opposite sides of the slot 94 which extend in the direction parallel to the shut-off plate 92. Each of the projections or fingers 98 are likewise in substantial alignment with each other as best illustrated in FIG. 19 so as to form a corresponding slot 100 between the shut-off plate 92 and the respective projections 98 as previously explained and as again illustrated in FIGS. 20 and 23. The slots 100 formed by the aligned projection members 98 function in a similar capacity to the slots 52 associated with tie member 10 thereby enabling the respective side wall bracket members 140 to be grabbed by and secured within the ICF block forming tool in a single form and in a stacking arrangement. The projections 98 again function as tool engaging members for securing the field assembled side wall bracket members 140 within a particular tool cavity.

Figure 24:
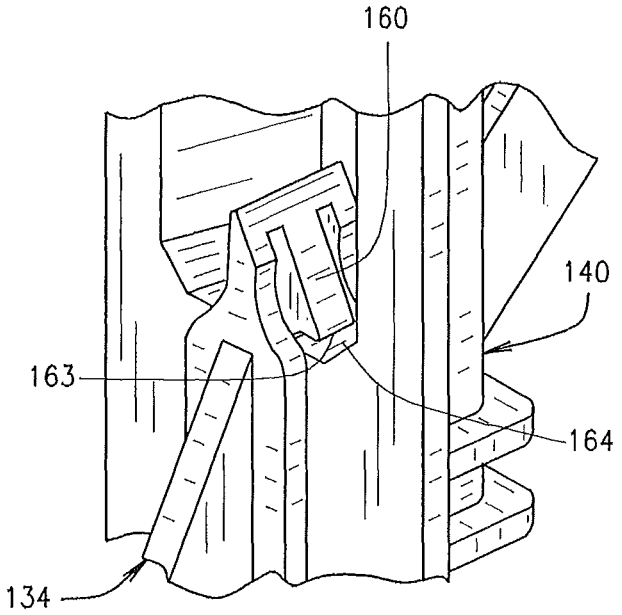
FIG. 24 is a partial perspective view showing the engagement of one of the locking mechanisms associated with the field assembled web member with a corresponding side wall bracket member.

As best illustrated in FIGS. 18, 21, 22 and 24, the web member 134 includes at least one snap locked stop member 136 associated with at least the top end portion of each respective end portion 138, the stop member 136 functioning to position and locate the web member 134 in proper position within the slot 94 associated with each opposed side wall bracket member 140. As best illustrated in FIGS. 18, 21 and 22, each opposite end portion of each end portion 138 of web member 134 includes a stop member 136. The stop member 136 is best illustrated in FIG. 24 and includes a resilient projection or locking member 160 which is positioned and located on one side portion of each respective end portion 138, such as the front portion of web member 134 as illustrated in FIG. 21. The opposite side of each respective end portion 138 incorporating the snap locked stop member 136 is best illustrated in FIG. 22 and includes an open space or cavity 162 for allowing the projection member 160 to be moved or flexed into the space 162 as a respective end portion 138 of web member 134 is slidably engaged with and moved through the corresponding slots 94 associated with the opposed side wall bracket members 140. In this regard, the resilient locking member 160 is sized and shaped so that the resilient member 160 associated with the respective bottom portions of the end portions 138 of web member 134 is automatically moved or flexed into space 162 as the web member 134 is slidably moved into slot portion 94A and the resilient member 160 is further moved or flexed into space 162 as the web member 134 is moved from slot portion 94A into slot portion 94B. This automatic flexing of the member 160 as it is inserted into slot 94 occurs due to the tapered or angular slope or shape of the member 160 as best illustrated in FIGS. 21 and 24. Because the resilient locking members 160 associated with the top and bottom end portions of web end portions 138 are mirror images of each other, the bottom resilient member 160 will always be properly oriented for slidably engaging slot 94 and flexing into space 162 regardless of which opposite end portion of web end portions 138 is inserted into slot 94.

As the bottom end portion of each web end portion 138 continues its movement through slot portion 94B and back into the lower slot portion 94A, the resilient projection stop member 160 is allowed to move back at least partially towards its original non-flexed position. As projection member 160 associated with the top portion of each respective web end portion 138 approaches slot portion 94B, because of the orientation of the upper stop member 160, the surface 163 associated with resilient member 160 will engage the ledge portion 164 positioned and located between slot portion 94A and slot portion 94B. This engagement of stop member 160 with ledge portion 164 prevents the web member 134 from passing completely through corresponding slots 94 and functions to hold the web member 134 in proper position and engagement with the side wall bracket members 140 as best illustrated in FIG. 24. As the top stop member 160 associated with web member 134 approaches the ledge portion 164, and just prior to engagement therewith, the lower stop member 160 exits slot portion 94B and enters the lower slot portion 94A thereby allowing stop member or projection 160 to at least partially return to its original non-flexed position so as to engage a corresponding lower ledge portion 166 as best illustrated in FIG. 19. As a result, the top stop member 160 engages ledge portion 164 and prevents the web member 134 from being moved further in a downward direction, and the lower stop member 160 engages ledge portion 166 and prevents the web member 134 from being moved in an upward direction.

If stop members 160 are utilized at each opposite end portion of each of the opposed web end portions 138, the web member 134 is locked into position within the respective side wall brackets 140 and cannot be removed therefrom once engaged therewith. On the other hand, if only the top stop members 160 are utilized in association with the top end portion of each respective web end portion 138, such stop members function to stop the travel of the web member 134 when positioned within the opposed slots 94 and likewise function to properly position and hold the web member in place within a particular ICF block. In this arrangement, the web member can be removed from the corresponding side wall bracket members 140 by moving the web member 134 upwardly and out of the corresponding slots 94. It is also recognized that one stop mechanism 136 can be utilized at the top portion of one of the web end portions 138 so as to stop the travel of the web member 134 when positioned within the corresponding slots 94 associated with a pair of side wall bracket members 140, and it is also recognized and anticipated that a single stop mechanism 136 can be associated with the top portion of one of the web end portions 138 and another stop mechanism 136 can be associated with the bottom portion of the other web end portion 138 so as to both stop and physically hold the web member 134 in proper position within the corresponding slots 94 associated with a pair of side wall bracket members 140 thereby likewise preventing the web member 134 from being removed from engagement with the bracket members 140. Any of these various configurations and arrangements can be utilized including a different type of lock mechanism 136 to hold and/or secure the web member 134 in proper engaged position with a pair of side wall bracket members 140.

As best illustrated in FIG. 18, the web member 134 likewise includes at least one rebar seat 54 as previously explained with respect to tie members 10 and 108, each rebar seat 54 likewise forming a substantially U-shaped well formed by a pair of adjacent fingers 58 and the inwardly spanning lateral knuckles or projections 59 as previously explained. The web member 134 likewise includes transverse bridging member 106 as previously explained.

As with side wall brackets 12, the side wall brackets 140 are likewise similarly encapsulated within a corresponding ICF panel member similar to the encapsulation and placement of the side wall brackets 12 and 110 associated with tie members 10 and 108. As such, since the web member 134 is likewise slidably engageable with a pair of side wall bracket members 140 embedded in opposed ICF panel members, the respective ICF panel members can be individually formed and shipped to a particular construction site in their unassembled state in a substantially flat form thereby again saving space for packaging, storing and shipping to a particular location. The present field assembled ICF blocks can then be easily assembled on-site by merely engaging the corresponding web members 134 with a pair of corresponding side wall brackets 140 associated with two opposed ICF panel members to complete the assembly process. Once engaged with a pair of opposed side wall bracket members 140, the field assembled web member 134 provides centralized support to the ICF block when cooperatively engaged with the corresponding side wall brackets 140.

It is also recognized and anticipated that the interlocking mechanism 120 associated with tie members 108 and 132 can take on a wide variety of different types of locking mechanisms so long as the locking mechanism is associated with both the top and bottom portions of the respective side wall bracket members. In this regard, it is also recognized that interlocking mechanism 120 can also be associated with fastening plate 18, with shut-off plates 20 and 92, or with any other side wall bracket member structure associated with the top and bottom portions of the side wall bracket members. This allows for variation in the structure of the side wall bracket members depending upon the size and shape of the particular ICF panel and/or block being used.

Still further, each side wall bracket member 140 may further include a reinforcing support member such as the member 168 illustrated in FIG. 18 located on one side of the shut-off plate 92 directly behind and opposite slot portion 94B to increase the tensile strength of the shut-off plate in the area where the web member 134 will be engaged. The reinforcing support member 168 may take the form of alternating or spaced ribs 170 which reduces the amount of material used as compared to a solid support member. The reinforcing member 168 also increases the tensile strength of the overall tie structure 132 when the web member 134 is engaged with the opposed side wall bracket members 140.

Like tie members 10 and 108, the modular nature of the present field assembled tie member 132 likewise promotes economy of scales with respect to manufacturing ICF blocks of different widths and different heights. As with tie members 10 and 108, the web member 134 associated with the present field assembled tie member 132 can likewise be made in different widths while utilizing the same side wall bracket members 140. Here again, this reduces tooling costs and enables a manufacturer to produce a wide variety of different web member lengths to achieve the desired the ICF block widths. In similar fashion, field assembled ICF blocks of varying heights can likewise be easily produced in heights corresponding to the multiple heights of the field assembled tie member 140 as previously explained with respect to the tie member 10, or any number of a single pre-selected block height and corresponding field assembled tie member height can be used to stack multiple blocks one on top of the other to achieve a desired height based upon multiples of the preselected block heights.

Figure 28:
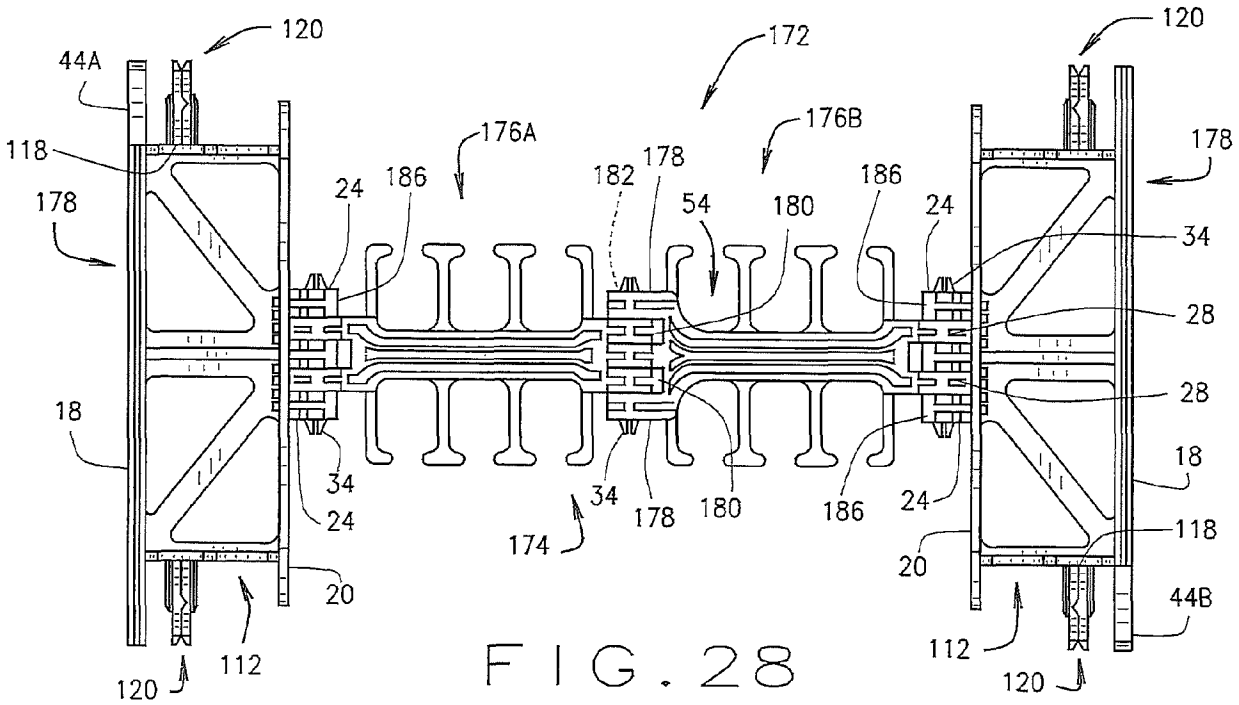
FIG. 28 is a side elevational view of still another embodiment of a stackable/foldable tie member constructed according to the teachings of the present invention.
Figure 29:
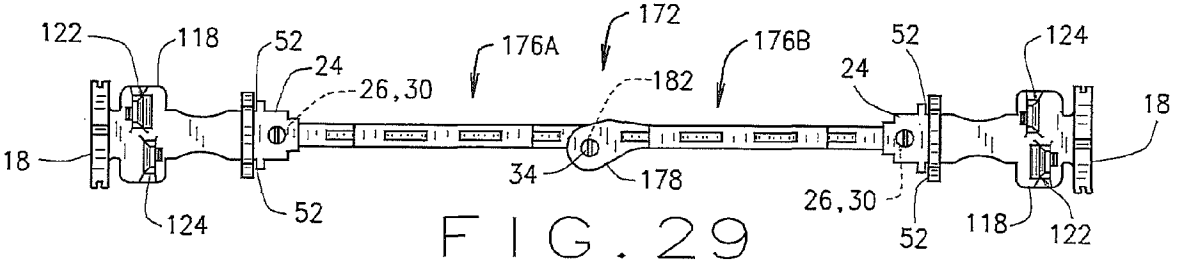
FIG. 29 is a top plan form view of the tie member of FIG. 28.

In still a further aspect of the present invention, FIGS. 28-31 illustrate still another embodiment of the present tie member, namely, tie member 172 constructed in accordance with the teachings of the present invention. The tie member 172 is substantially identical to tie members 10 and 108 except that tie member 172 includes a slightly different foldable web portion 174 as will be hereinafter explained. In tie member 172, the web portion 174 includes a pair of cooperatively engageable connection link members 176A and 176B as best illustrated in FIG. 29. More particularly, tie member 172 includes a pair of opposed side wall bracket members 178 which are substantially identical to side wall bracket members 110 in that they each include a fastening plate 18, a spaced apart shut-off plate 20, and a plurality of bridging members connected therebetween forming a substantially similar trust structure 112 therebetween. The side wall bracket members 178 likewise include interlocking mechanism 120 associated with each platform member 118 as previously explained with respect to tie member 108. Fastening plates 18 associated with each opposed side wall bracket member 178 may likewise include an overlapping extension portion 44 such as extension portions 44A and 44B previously discussed with respect to tie members 10 and 108.

Connection link members 176A and 176B differ in structure from link members 16A and 16B previously discussed with respect to foldable tie members 10 and 108 in the formation and positioning of the plurality of spaced projections 178 and 180 associated with the opposite end portions of the respective link members 176A and 176B which pivotally connect together. Like link members 16A and 16B, one end portion of each of the respective link members 176A and 176B includes a complimentary plurality of spaced projections 28 having an opening 30 extending respectively therethrough, the projections 28 being positioned and located so as to be slidably received within the spaces 32 located between the side wall bracket projections 24 as best illustrated in FIGS. 1, 2, 28 and 29. When the projections 28 associated with one end portion of each respective connection link member 176A and 176B are cooperatively engaged with the corresponding side wall bracket projections 24, the respective openings 26 and 30 are aligned and are adapted to receive a pin member 34 therethrough as previously explained. Once pin member 34 is engaged with the respective projection members 24 and 28, each respective connection link member 176A and 176B is pivotally attached to its corresponding side wall bracket member 178 adjacent the shut-off plate 20.

Figure 30:
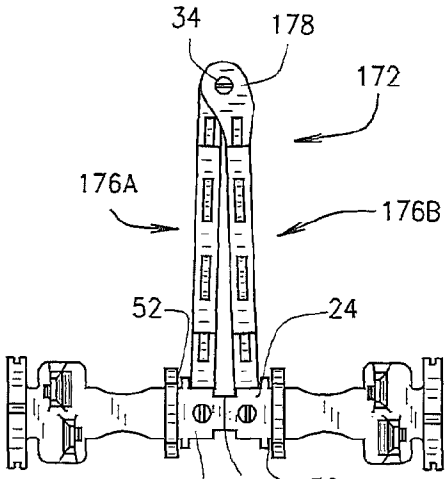
FIG. 30 is a top plan form view of the tie member of FIGS. 28 and 29 shown in its folded, collapsed position.
Figure 31:
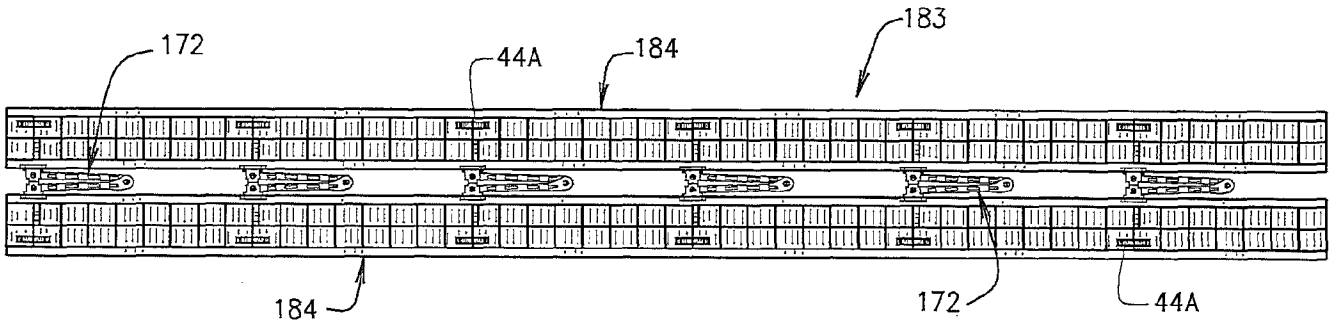
FIG. 31 is a top plan form view of an ICF block utilizing the tie member of FIGS. 28-30 shown in its folded, collapsed position.

Importantly, the opposite end portions of each of the connection link members 176A and 176B likewise include cooperatively engageable projections 178 and 180 each having a respective opening 182 adapted to receive the pin member 34 as previously explained. As best illustrated in FIGS. 28 and 29, one of the opposed end portions of the respective connection link members 176A and 176B, such as link member 176A, includes at least a pair of spaced apart projections or hinge members 180 each including a respective opening 182 extending therethrough, while the other connection link member, such as link member 178B, includes three (3) complimentary spaced apart projections or hinge members 178 each likewise including a respective opening 182 extending therethrough. When the link members 176A and 176B are cooperatively engaged to each other, the respective, openings 182 are aligned with each other but they are slightly offset from the openings 26, 30 associated with the respective end portions of link members 176A and 176B engaged with the side wall bracket members 178. In other words, the center pin member 34 associated with web portion 174 is slightly offset and is not in alignment with the pin members 34 associated with each opposite end portion of the respective link members 176A and 176B as best illustrated in FIG. 29. This offset arrangement is achieved by angularly orienting the projection members 178 and 180 as best illustrated in FIGS. 29 and 30 and positioning the respective openings 182 therethrough such that, when the projections 178 and 180 are engaged, the aligned openings 182 are offset from the aligned openings 26, 30. This offset arrangement likewise enables the tie member 172 to be folded as illustrated in FIGS. 30 and 31 such that the respective ICF panel members 184 forming the ICF block 183 will fold in perfect alignment with each other. This folding arrangement is different from the folding arrangement illustrated in FIG. 9 wherein tie members 10 and 108 enable the respective blocks 60 to be folded in an offset manner from each other as previously explained. Since the tie members 172 are pivotally attached to the respective ICF panel members 184 at their respective shut-off plates 20 and since the respective connection link members 176A and 176B are likewise pivotally connected to each other as just explained, this hinged configuration allows each respective tie member 172 associated with each respective ICF block 183 to be folded as illustrated in FIG. 31.

Still further, it is important to note that each of the spaced projections 24 associated with the respective side wall bracket members 178 include a terminal end surface portion 186 as best illustrated in FIGS. 2, 28 and 29, which surface 186 functions as a stacking pad when the respective tie members 172 are folded as illustrated in FIGS. 30 and 31. In other words, each terminal end surface or stacking pad 186 associated with each of the spaced projection members 24 associated with one of the side wall bracket members 178 forming tie member 172 will abut a corresponding stacking pad 186 associated with each of the spaced projection members 24 associated with the other side wall bracket member 178 forming tie member 172 when the tie member 172 is fully folded as illustrated in FIGS. 30 and 31. As a result, the weight of the respective panel members 184 associated with a particular block 183 will be distributed and supported by the respective stacking pads 186 when a particular ICF block such as block 183 is positioned in its folded position for packaging, storage, shipping, inventory, site storage and/or site staging. In addition, when a plurality of blocks 183 are stacked one upon the other in their respective folding positions, the weight associated with all of the respective blocks 183 will be distributed and supported by the respective stacking pads 186 thereby relieving pressure and stress that would ordinarily be applied to the respective panel members 184 and the respective connection link members such as link members 16A and 16B illustrated in FIG. 9. Abutting the terminal end portions 186 of each respective projection member 24 when ICF blocks utilizing tie members 172 are positioned in their folded position as illustrated in FIG. 31 helps to prevent damage to the respective panel members 184 as well as to respective tie members 172 during shipment, movement and storage of the ICF blocks from one location to another.

In all other respects, tie member 172, side wall bracket members 178, connection link members 176A and 176B, the interlocking mechanism 120, pin members 34, tool engaging slots 52, and rebar seats 54 all function and operate as previously described with respect to tie members 10 and 108.

It should also be recognized that field assembled blocks constructed in accordance with the teachings of the present invention will stack on pre-assembled folding blocks constructed according to the teachings of the present invention such as the blocks 60 illustrated in FIGS. 4 and 9, and that the field assembled tie member 132 will likewise cooperatively engage and stack on top of folding tie members 10, 108 and 172. This is true for several reasons. First of all, the array of alternating teeth 68 and sockets 70 formed on the opposing horizontal longitudinal edges of each of the ICF panel members such as panel members 62 illustrated in FIGS. 4-7 and 9, as well as the array of teeth 76 and sockets 78 formed on the opposing vertical ends of each panel member are substantially identical regardless of which of the present tie members are utilized to form the overall block. As a result, the individual panel members and blocks formed therefrom will cooperatively engage each other both horizontally and vertically as previously explained. Secondly, the overlapping arrangement of the fastening plate extension portions 44A and 44B and their corresponding gripping means 46 as well as the interlocking mechanism 120 associated with the side wall bracket members 12, 110, 140 and 178 are all substantially identical and each of these mechanisms will cooperatively engage each other when one ICF block is vertically stacked on top of another ICF block constructed in accordance with the teachings of the present invention, This is also true even if the ICF blocks constructed in accordance with the teachings of the present invention are vertically stacked in an offset arrangement relative to each other since the first and second interlocking members or finger extensions 122 and 124 associated with the interlocking mechanism 122 on one ICF panel will engage or extend into a socket 70 associated with a corresponding ICF panel when the two panels are cooperatively engaged in an offset arrangement.

It is likewise recognized and anticipated that any combination of the overlapping extension members 44A and 44B, the gripping means 46, and the interlocking mechanisms 120 can be used with any of the various folding and field assembled tie members discussed above.

As a result, the various embodiments of the present tie members 10, 108, 132 and 172 facilitate producing a wide variety of different ICF block widths and heights while saving tooling costs and manufacturing costs as previously explained.

Although ICF blocks 60, 80, 82 and 183 represent a substantially planar ICF form construction, it is recognized and anticipated that any angularly oriented block form construction can be constructed in accordance with the teachings of the present invention wherein each opposing panel forming a particular block construction can include two substantially planar sections positioned and located at any angular orientation relative to each other depending upon the particular application. This angular orientation can vary between 0° and 90° depending upon the particular application. In addition, any plurality of the present tie members 10, 108, 132 and 172 can be used to form any pre-selected ICF block height and width. Also, importantly, the present side wall bracket members 12, 110, 140 and 178 with the extension portions 44A and 44B and/or interlocking mechanisms 120 can be utilized with any tie member construction including an integrally formed one-piece tie member, any type of foldable tie member, and any type of slidably engageable tie member.

As is evident from the foregoing description, certain aspects of the present invention are not limited by the particular details of the examples illustrated herein and it is therefore contemplated that other changes, modifications, variations and other uses and applications of the present invention, or equivalents thereof, will become apparent to those skilled in the art after considering this specification and the accompanying drawings. All such drawings, modifications, variations and other uses and applications which do not depart from the spirit and scope of the present invention are deemed to be covered by the present invention which is limited only by the claims which follow.

The invention claimed is:

1. A tie member for connecting first and second panel members in a spaced substantially parallel relationship, each of said panel members having a pair of horizontally opposed longitudinal edges, a pair of vertically opposed longitudinal edges, and inner and outer surfaces, said tie member comprising:

a pair of said wall bracket members each respectively mountable within one of said first and second panel members; and a web member extending between said pair of side wall bracket members;

each of said side wall bracket members including a fastening plate and a shut-off plate, said shut-off plates being position adjacent the inner surfaces of said first and second panel members, each of said side wall bracket members further including an interlocking mechanism associated with each opposite end of each of said side wall bracket members, said interlocking mechanism being spaced from and positioned intermediate between said fastening plate and said shut-off plate, said interlocking mechanism including first and second interlocking members associated with each opposite end of each of said side wall bracket members, said pair of first and second interlocking members being further positioned adjacent to each other in a lateral offset arrangement intermediate said fastening plate and said shut-off plate, the first interlocking member of one end of each of said side wall bracket members being engageable with the second interlocking member of one end of each of said side wall bracket members associated with another one of said tie members, at least some of said first and second interlocking members extending into the opposed horizontal longitudinal edges of said first and second panel members.

2. The tie member defined in claim 1 wherein one of said first and second interlocking members includes at least one projection and the other of said first and second interlocking members includes at least one groove, the at least one projection of one of said first and second interlocking members associated with one end of each of said side wall bracket members being cooperatively engageable with the at least one groove of the other of said first and second interlocking members associated with one end of each of said side wall bracket members associated with another one of said tie members.

3. The tie member defined in claim 1 wherein at least some of said first and second interlocking members extending into a respective tooth associated with the opposed horizontal longitudinal edges of the first and second panel members.

4. The tie member defined in claim 1 wherein each of said side wall bracket members includes an extension portion associated with each opposite end thereof, the extension portions of one end of the side wall bracket members associated with one of said tie members being positionable in overlapping relationship with the extension portions of one end of the side wall bracket members associated with another one of said tie members when one tie member is stacked upon another tie member, at least one of said extension portions extending into the horizontally opposed longitudinal edges associated with at least one of said first and second panel members.

5. The tie member defined in claim 4 wherein each of the extension portions associated with said side wall bracket members include an engaging member that will mate with a corresponding engaging member associated with another tie member when a pair of tie members are positioned in overlapping relationship to each other.

6. The tie member defined in claim 1 wherein said web member includes opposite end portions, the opposite end portions of said web member being pivotally connected to said side wall bracket members.

7. The tie member defined in claim 6 wherein each side wall bracket member includes a plurality of spaced projections extending into the space foamed between said first and second panel members, the opposite end portions of said web member each including a complementary plurality of spaced projections, the spaced projections of said web member being cooperatively engageable with the plurality of projections associated with said side wall bracket members for pivotally connecting the opposite end portions of said web member to said side wall bracket members.

8. The tie member defined in claim 7 wherein said web member includes a pair of cooperatively engageable connection link members, one end portion of each of said connection link members including a plurality of spaced projections for cooperatively engaging the plurality of spaced projections associated with said side wall bracket members for pivotal connection thereto, the opposite end portion of each of said connection link members being pivotally connected to each other.

9. The tie member defined in claim 8 wherein the pivotable connections between the opposite end portions of said web member and said side wall bracket members and between the opposite end portions of said connection link members are in alignment with each other when said first and second panel members are in a substantially parallel relationship to each other.

10. The tie member defined in claim 8 wherein the pivotable connections between the opposite end portions of said web member and said side wall bracket members are in alignment with each other when said first and second panel members are in a substantially parallel relationship to each other, and wherein the pivotable connections between the opposite end portions of said connection link members are offset from the pivotable connections between said web member and said side wall bracket members when said first and second panel members are in a substantially parallel relationship to each other.

11. The tie member defined in claim 10 wherein each plurality of spaced projections associated with each side wall bracket member extending into the space formed between said first and second panel members includes a terminal end surface, said panel members being movable between a first position wherein said first and second panel members extend substantially parallel to one another and a second position wherein said first and second panel members are collapsed in a folded position, the terminal end surfaces of the projections associated with one of said side wall bracket members abutting the terminal end surfaces of the projections associated with the other of said side wall bracket members when said first and second panel members are collapsed in their folded position.

12. The tie member defined in claim 1 including at least one rebar seat associated with said web member.

13. The tie member defined in claim 1 wherein said web member includes opposite end portions, the opposite end portions of said web member being slidably engageable with said side wall bracket members.

14. The tie member defined in claim 13 wherein each of said side wall bracket members includes a slot accessible from the space formed between said first and second panel members, and the opposite end portions of said web member each include a correspondingly shaped end portion adapted to be slidably positioned within the slot associated with each of said side wall bracket members.

15. The tie member defined in claim 1 wherein each of said side wall bracket members include a tool engaging member associated with each of said shut-off plates for engaging at least one side wall of a tool member for forming the first and second panel members.

16. A tie member for connecting first and second panel members in a spaced substantially parallel relationship, each of said panel members having a pair of horizontally opposed longitudinal edges, a pair of vertically opposed longitudinal edges, and inner and outer surfaces, said tie member comprising:

a pair of side wall bracket members, one of said side wall bracket members being mountable within one of said first and second said panel members and the other of said side wall bracket members being mountable within the other of said first and second panel members, each side wall bracket member including a fastening plate, a shut-off plate and a truss structure extending therebetween, said shut-off plates being positioned adjacent the inner surfaces of said first and second panel members, each shut-off plate including a plurality of spaced projections each having an opening extending therethrough, said plurality of projections extending into, the space formed between said first and second panel members;

a web member extending between said pair of side wall bracket members, the opposite end portions of said web member each including a complimentary plurality of spaced projections each having an opening extending respectively therethrough, the spaced projections of said web member being cooperatively engageable with the plurality of projections associated with said pair of shut-off plates so as to position the respective openings associated with said projections in alignment with each other; and a pin member engageable with the respective aligned openings of said plurality of projections for pivotally connecting the opposite end portions of said web member to the shut-off plates of said side wall bracket members;

each of said fastening plates including an extension portion associated with each opposite end thereof, each extension portion extending in a vertical plane in alignment with said fastening plate and including an engaging member, the extension portions of one end of the fastening plates associated with one of said tie members being positionable in overlapping vertical relationship with the extension portions of one end of the fastening plates associated with another one of said tie members and the engaging members associated with said extension portions mating with and engaging corresponding engaging members associated with another tie member when a pair of tie members are positioned in overlapping relationship to each other, at least some of said extension portions extending into the opposed horizontal longitudinal edges of said first and second panel members.

17. The tie member defined in claim 16 wherein said web member includes a pair of cooperatively engageable connection link members, one end portion of each of said connection link members including a plurality of spaced projections for cooperatively engaging the plurality of spaced projections associated with said pair of shut-off plates for pivotable connection thereto, the opposite end portion of each of said connection link members being pivotally connected to each other.

18. The tie member defined in claim 17 wherein the opposite end portion of each of said connection link members includes a plurality of spaced projections each having an opening extending therethrough, the spaced projections associated with the opposite end portion of one of said connection link members being cooperatively engageable with the spaced projections associated with the opposite end portion of the other of said connection link members so as to position the respective openings associated with said projections in alignment with each other, and a pin member engageable with the respective aligned openings of said plurality of projections associated with the opposite end portions of said pair of connection link members for pivotally connecting said connection link members together.

19. The tie member defined in claim 18 wherein said plurality of projections associated with said connection link members and said shut-off plates are cog type hinge members.

20. The tie member defined in claim 17 wherein the projections of said shut-off plates, the projections of said connection link members, and said pivotable connection between said connection link members are cog type hinge members.

21. The tie member defined in claim 17 including at least one rebar seat associated with each of said connection link members.

22. The tie member defined in claim 16 wherein at least one of the extension portions associated with some of said fastening plates extend into a respective tooth associated with the opposed horizontal longitudinal edges of the first and second panel members.

23. The tie member defined in claim 22 wherein at least some of said extension portions associated with some of said fastening plates are at least partially encapsulated within a tooth associated with a horizontal longitudinal edge of said first and second panel members.

24. The tie member defined in claim 16 including a tool engaging member associated with the plurality of spaced projections associated with each of said shut-off plates for engaging at least one side wall of a tool member for forming the first and second panel members.

25. The tie member defined in claim 24 wherein said tool engaging member includes a plurality of opposed projections which extend in a direction parallel to the plane of said shutoff plate, said opposed projections forming a corresponding slot on opposite sides of said spaced projections between said shut-off plate and said plurality of opposed projections for engaging a corresponding side wall associated with a tool member for forming the first and second panel members.

26. The tie member defined in claim 16 including at least one rebar seat associated with said web member.

27. The tie member defined in claim 16 wherein said pin member includes a slotted end portion associated with each opposite end thereof.

28. The tie member defined in claim 27 wherein said slotted end portions are formed by flange portions which are arrowhead in shape.

29. The tie member defined in claim 28 wherein the flange portions include at least one edge portion which will engage at least one of the spaced projections and function as a stop member when a pin member is engaged with the aligned openings of said projections.

30. The tie member defined in claim 16 including a plurality of said tie members extending between said first and second panel members at a plurality of spaced locations along the length of said panel members, said panel members being movable between a first position wherein said first and second panel members extend substantially parallel to one another and a second position wherein said first and second panel members are collapsed in a folded position.

31. The tie member defined in claim 16 including an interlocking mechanism associated with each opposite end of each of said side wall bracket members, said interlocking mechanism being positioned and located between said fastening plate and said shut-off plate, the interlocking mechanism of one end of each of the side wall bracket members being cooperatively engageable with the interlocking mechanism of one end of each of the side wall bracket members associated with another one of said tie members.

32. The tie member defined in claim 31 wherein said interlocking mechanism includes a pair of first and second interlocking members positioned adjacent to each other in a lateral offset arrangement, the first interlocking member of one end of each of the side wall bracket members being engageable with the second interlocking member of one end of each of the side wall bracket members associated with another one of said tie members.

33. The tie member defined in claim 32 wherein one of said first and second interlocking members includes at least one projection and the other of said first and second interlocking members includes at least one groove, the at least one projection of one of said first and second interlocking members associated with one end of each of the side wall bracket members being cooperatively engageable with the at least one groove of the other of said first and second interlocking members associated with one end of each of the side wall bracket members associated with another one of said tie members.

34. The tie member defined in claim 32 wherein one of said first and second interlocking members includes at least one projection and the other of said first and second interlocking members includes at least one projection, the at least one projection of one of said first and second interlocking members associated with one end of each of said side wall bracket members being cooperatively engageable with the at least one projection of the other of said first and second interlocking members associated with one end of each of said side wall bracket members associated with another one of said tie members.

35. The tie member defined in claim 32 wherein at least some of said first and second interlocking members extend into the opposed horizontal longitudinal edges of said first and second panel members.

36. The tie member defined in claim 35 wherein said first and second panel members each include at least one row of teeth and sockets positioned along each horizontal longitudinal edge, the teeth associated with one of the opposed horizontal longitudinal edges of said first and second panel members being vertically aligned with the sockets associated with the other of the opposed horizontal longitudinal edges, and the sockets associated with one of the opposed horizontal longitudinal edges of said first and second panel members being vertically aligned with the teeth associated with the other of the opposed horizontal longitudinal edges, at least some of said first and second interlocking members extending into a respective tooth associated with the opposed horizontal longitudinal edges of said first and second panel members.

37. The tie member defined in claim 16 wherein said first and second panel members each include a corresponding array of teeth and sockets positioned and located along each of the vertically opposed edges of the pair of panel members forming the ICF block.

38. A tie member for connecting first and second panel members in a spaced substantially parallel relationship to each other, said first and second panel members each having a pair of horizontally opposed longitudinal edges, a pair of vertically opposed longitudinal edges, and inner and outer surfaces, said pair of horizontally opposed longitudinal edges including at least one row of teeth and sockets, said tie member comprising:

a pair of side wall bracket members each respectively mountable within one of said first and second panel members, each side wall bracket member including a fastening plate, a shut-off plate, and a truss structure extending therebetween, said shut-off plate being positioned adjacent the inner surfaces of said first and second panel members, each shut-off plate including a plurality of spaced projections each having an opening extending therethrough, said plurality of projections extending into the space formed between said first and second panel members;

a pair of cooperatively engageable connection link members extending between said pair of side wall bracket members, one end portion of each of said connection link members including a complimentary first plurality of spaced projections each having an opening extending therethrough, said first plurality of spaced projections being cooperatively engageable with said plurality of space projections associated with said pair of shut-off plates so as to position the respective openings associated with said projections in alignment with each other, the opposite end portion of each of said connection link members including at least a pair of second spaced projections each having an opening extending therethrough, said at least a pair of second spaced projections being cooperatively engageable with each other so as to position the respective openings associated therewith in alignment with each other; and a pin member engageable with the respective aligned openings of said first and second spaced projections for pivotally connecting one end portion of said pair of connection link members to a respective shut-off plate and for pivotally connecting the opposite end portions of said pair of connection link members to each other;

each of said fastening plates including an extension portion associated with each opposite end portion thereof, the extension portion associated with one end of each of said fastening plates being offset from the extension portion associated with the opposite end of each of said fastening plates for mating said fastening plates in overlapping relationship to each other when one tie member is stacked upon another tie member, at least some of said extension portions extending into and being at least partially encapsulated by a respective tooth associated with the pair of horizontally opposed longitudinal edges associated with each of said first and second panel member.

39. The tie member defined in claim 38 including at least one set of opposed projections associated with the plurality of spaced projections of each of said shut-off plates, said at least one set of opposed projections extending in a direction parallel to the plane of said shutoff plate and forming a corresponding slot on each side of said plurality of spaced projections between said opposed projections and said shut-off plate, said slots enabling the respective side wall bracket members to be secured within a tool member for forming said first and second panel members.

40. The tie member defined in claim 39 wherein a plurality of tie members can be positioned in a stacked arrangement within a tool member for forming the first and second panel members such that the adjacent tie members have at least one of their respective fastening plate extension portions positioned in overlapping relationship with each other when said tool engaging slots are secured within a tool member.

41. The tie member defined in claim 38 wherein a plurality of said tie members extend between said first and second panel members at a plurality of spaced locations along the length of said first and second panel members, said first and second panel members being movable between an open position wherein said first and second panel members extend substantially parallel to one another and a collapsed position wherein said first and second panel members are foldable about said pin members.

42. The tie member defined in claim 38 including an interlocking mechanism associated with each opposite end of each of said side wall bracket members, said interlocking mechanism being positioned and located between said fastening plate and said shut-off plate, the interlocking mechanism of one end of each of the side wall bracket members being cooperatively engageable with the interlocking mechanism of one end of each of the side wall bracket members associated with another one of said tie members.

43. The tie member defined in claim 42 wherein said interlocking mechanism includes a pair of first and second interlocking members positioned adjacent to each other in a lateral offset arrangement, the first interlocking member of one end of each of the side wall bracket members being engageable with the second interlocking member of one end of each of the side wall bracket members associated with another one of said tie members.

44. The tie members defined in claim 43 wherein at least some of said first and second interlocking members extend into the opposed horizontal longitudinal edges of said first and second panel members.

45. A tie member for connecting first and second panel members in a spaced substantially parallel relationship, each of said panel members having a pair of horizontally opposed longitudinal edges, a pair of vertically opposed longitudinal edges, and inner and outer surfaces, said tie member comprising:

a pair of side wall bracket members, one of said side wall bracket members being mountable within one of said first and second said panel members and the other of said side wall bracket members being mountable within the other of said first and second panel members, each side wall bracket member including a fastening plate, a shut-off plate and a truss structure extending therebetween, said shut-off plates being positioned adjacent the inner surfaces of said first and second panel members, each shut-off plate including a plurality of spaced projections each having an opening extending therethrough, said plurality of projections extending into the space formed between said first and second panel members;

a web member extending between said pair of side wall bracket members, the opposite end portions of said web member each including a complimentary plurality of spaced projections each having an opening extending respectively therethrough, the spaced projections of said web member being cooperatively engageable with the plurality of projections associated with said pair of shut-off plates so as to position the respective openings associated with said projections in alignment with each other;

a pin member engageable with the respective aligned openings of said plurality of projections for pivotally connecting the opposite end portions of said web member to the shut-off plates of said side wall bracket members; and an interlocking mechanism associated with each opposite end of each of said side wall bracket members, said interlocking mechanism being spaced from and positioned intermediate between said fastening plate and said shut-off plate, said interlocking mechanism including a pair of first and second interlocking members positioned adjacent to each other in a lateral offset arrangement intermediate said fastening plate and said shut-off plate, the first interlocking member of one end of each of the side wall bracket members being engageable with the second interlocking member of one end of each of the side wall bracket members associated with another one of said tie members.

46. The tie member defined in claim 45 wherein one of said first and second interlocking members includes at least one projection and the other of said first and second interlocking members includes at least one groove, the at least one projection of one of said first and second interlocking members associated with one end of each of the side wall bracket members being cooperatively engageable with the at least one groove of the other of said first and second interlocking members associated with one end of each of the side wall bracket members associated with another one of said tie members.

47. The tie member defined in claim 45 wherein one of said first and second interlocking members includes at least one projection and the other of said first and second interlocking members includes at least one projection, the at least one projection of one of said first and second interlocking members associated with one end of each of said side wall bracket members being cooperatively engageable with the at least one projection of the other of said first and second interlocking members associated with one end of each of said side wall bracket members associated with another one of said tie members.

48. The tie member defined in claim 45 wherein at least some of said first and second interlocking members extend into the opposed horizontal longitudinal edges of said first and second panel members.

49. The tie member defined in claim 48 wherein said first and second panel members each include at least one row of teeth and sockets positioned along each horizontal longitudinal edge, the teeth associated with one of the opposed horizontal longitudinal edges of said first and second panel members being vertically aligned with the sockets associated with the other of the opposed horizontal longitudinal edges, and the sockets associated with one of the opposed horizontal longitudinal edges of said first and second panel members being vertically aligned with the teeth associated with the other of the opposed horizontal longitudinal edges, at least some of said first and second interlocking members extending into a respective tooth associated with the opposed horizontal longitudinal edges of said first and second panel members.

50. The tie member defined in claim 45 wherein said web member includes a pair of cooperatively engageable connection link members, one end portion of each of said connection link members including a plurality of spaced projections for cooperatively engaging the plurality of spaced projections associated with said pair of shut-off plates for pivotable connection thereto, the opposite end portion of each of said connection link members being pivotally connected to each other.

51. The tie member defined in claim 50 wherein the opposite end portion of each of said connection link members includes a plurality of spaced projections each having an opening extending therethrough, the spaced projections associated with the opposite end portion of one of said connection link members being cooperatively engageable with the spaced projections associated with the opposite end portion of the other of said connection link members so as to position the respective openings associated with said projections in alignment with each other, and a pin member engageable with the respective aligned openings of said plurality of projections associated with the opposite end portions of said pair of connection link members for pivotally connecting said connection link members together.

52. The tie member defined in claim 51 wherein the spaced projections associated with the opposite end portion of one of said connection link members includes two spaced projections, and wherein the spaced projections associated with the opposite end portion of the other of said connection link members includes three spaced projections.

53. The tie member defined in claim 50 including at least one rebar seat associated with each of said connection link members.

54. The tie member defined in claim 45 wherein said first and second panel members each include at least one row of teeth and sockets positioned along each horizontal longitudinal edge, the teeth associated with one of the opposed horizontal longitudinal edges of said first and second panel members being vertically aligned with the sockets associated with the other of the opposed horizontal longitudinal edges, and the sockets associated with one of the opposed horizontal longitudinal edges of said first and second panel members being vertically aligned with the teeth associated with the other of the opposed horizontal longitudinal edges.

55. The tie member defined in claim 45 wherein each of said fastening plates includes an extension portion associated with each opposite end portion thereof, the extension portions of one end of the fastening plates associated with one of said tie members being positionable in overlapping relationship with the extension portions of one end of the fastening plates associated with another one of said tie members, at least some of said extension portions extending into the opposed horizontal longitudinal edges of said first and second panel members.

56. The tie member defined in claim 55 wherein said first and second panel members each including at least one row of teeth and sockets, and wherein at least one of the extension portions associated with at least one of said fastening plates extend into a respective tooth associated with the opposed horizontal longitudinal edges of said first and second panel members.

57. The tie member defined in claim 56 wherein at least some of said extension portions associated with some of said fastening plates are at least partially encapsulated within a tooth associated with a horizontal longitudinal edge of said first and second panel members.

58. The tie member defined in claim 45 including a tool engaging member associated with the plurality of spaced projections associated with each of said shut-off plates for engaging at least one side wall of a tool member for forming the first and second panel members.

59. The tie member defined in claim 58 wherein said tool engaging member includes a plurality of opposed projections which extend in a direction parallel to the plane of said shutoff plate, said opposed projections forming a corresponding slot on opposite sides of said spaced projections between said shut-off plate and said plurality of opposed projections, each of said slots being engageable with a corresponding side wall associated with a tool member for forming said first and second panel members.

60. The tie member defined in claim 45 including a reinforcing area of material located on one side portion of each of said shut-off plates directly behind and opposite the plurality of spaced projections associated respectively therewith.

61. The tie member defined in claim 45 including at least one rebar seat associated with said web member.

62. The tie member defined in claim 45 including a plurality of said tie members extending between said first and second panel members at a plurality of spaced locations along the length of said panel members, said panel members being movable between a first position wherein said first and second panel members extend substantially parallel to one another and a second position wherein said first and second panel members are collapsed in a folded position.

63. A tie member for connecting first and second panel members in a spaced substantially parallel relationship, each of said panel members having a pair of horizontally opposed longitudinal edges, a pair of vertically opposed longitudinal edges, and inner and outer surfaces, said tie member comprising:

a pair of side wall bracket members, one of said side wall bracket members being mountable within one of said first and second said panel members and the other of said side wall bracket members being mountable within the other of said first and second panel members, each side wall bracket member including a fastening plate, a shut-off plate and a truss structure extending therebetween, said shut-off plates being positioned adjacent the inner surfaces of said first and second panel members, each shut-off plate including a plurality of spaced projections each having an opening extending therethrough, said plurality of projections extending into the space formed between said first and second panel members;

a web member extending between said pair of side wall bracket members, the opposite end portions of said web member each including a complimentary plurality of spaced projections each having an opening extending respectively therethrough, the spaced projections of said web member being cooperatively engageable with the plurality of projections associated with said pair of shut-off plates so as to position the respective openings associated with said projections in alignment with each other;

a pin member engageable with the respective aligned openings of said plurality of projections for pivotally connecting the opposite end portions of said web member to the shut-off plates of said side wall bracket members;

an interlocking mechanism associated with each opposite end of each of said side wall bracket members, said interlocking mechanism being positioned and located between said fastening plate and said shut-off plate, said interlocking mechanism including a pair of first and second interlocking members positioned adjacent to each other in a lateral offset arrangement, the first interlocking member of one end of each of the side wall bracket members being engageable with the second interlocking member of one end of each of the side wall bracket members associated with another one of said tie members, at least some of said interlocking mechanisms extending into the opposed horizontal longitudinal edges of said first and second panel members; and each of said fastening plates including an extension portion associated with each opposite end thereof, the extension portions of one end of the fastening plates associated with one of said tie members being positionable in overlapping relationship with the extension portions of one end of the fastening plates associated with another one of said tie members, at least some of said extension portions extending into the opposed horizontal longitudinal edges of said first and second panel members.

64. The tie member defined in claim 63 wherein said web member includes a pair of cooperatively engageable connection link members, one end portion of each of said connection link members including a plurality of spaced projections for cooperatively engaging the plurality of spaced projections associated with said pair of shut-off plates for pivotable connection thereto, the opposite end portion of each of said connection link members being pivotally connected to each other.

65. The tie member defined in claim 64 wherein the opposite end portion of each of said connection link members includes a plurality of spaced projections each having an opening extending therethrough, the spaced projections associated with the opposite end portion of one of said connection link members being cooperatively engageable with the spaced projections associated with the opposite end portion of the other of said connection link members so as to position the respective openings associated with said projections in alignment with each other, and a pin member engageable with the respective aligned openings of said plurality of projections associated with the opposite end portions of said pair of connection link members for pivotally connecting said connection link members together.

66. The tie member defined in claim 63 wherein said first and second panel members each include at least one row of teeth and sockets positioned along each horizontal longitudinal edge, the teeth associated with one of the opposed horizontal longitudinal edges of said first and second panel members being vertically aligned with the sockets associated with the other of the opposed horizontal longitudinal edges, and the sockets associated with one of the opposed horizontal longitudinal edges of said first and second panel members being vertically aligned with the teeth associated with the other of the opposed horizontal longitudinal edges.

67. The tie member defined in claim 66 wherein at least one of the extension portions associated with some of said fastening plates extend into a respective tooth associated with the opposed horizontal longitudinal edges of said first and second panel members.

68. The tie member defined in claim 67 wherein at least one of said extension portions associated with some of said fastening plates are at least partially encapsulated within a tooth associated with a horizontal longitudinal edge of said first and second panel members.

69. The tie member defined in claim 63 including a tool engaging member associated with the plurality of spaced projections associated with each of said shut-off plates, said tool engaging member engaging at least one side wall of a tool member for forming said first and second panel members.

70. The tie member defined in claim 69 wherein said tool engaging member includes a plurality of opposed projections which extend in a direction parallel to the plane of said shutoff plate, said opposed projections forming a corresponding slot on opposite sides of said spaced projections between said shut-off plate and said plurality of opposed projections, each of said slots being engageable with a corresponding side wall associated with a tool member for forming said first and second panel members.

71. The tie member defined in claim 63 including at least one rebar seat associated with said web member.

72. The tie member defined in claim 63 including a plurality of said tie members extending between said first and second panel members at a plurality of spaced locations along the length of said panel members, said panel members being movable between a first position wherein said first and second panel members extend substantially parallel to one another and a second position wherein said first and second panel members are collapsed in a folded position.

73. The tie member defined in claim 63 wherein one of said first and second interlocking members includes at least one projection and the other of said first and second interlocking members includes at least one groove, the at least one projection of one of said first and second interlocking members associated with one end of each of the side wall bracket members being cooperatively engageable with the at least one groove of the other of said first and second interlocking members associated with one end of each of the side wall bracket members associated with another one of said tie members.

74. The tie member defined in claim 63 wherein one of said first and second interlocking members includes at least one projection and the other of said first and second interlocking members includes at least one projection, the at least one projection of one of said first and second interlocking members associated with one end of each of said side wall bracket members being cooperatively engageable with the at least one projection of the other of said first and second interlocking members associated with one end of each of said side wall bracket members associated with another one of said tie members.

75. The tie member defined in claim 63 wherein at least some of said first and second interlocking members extend into the opposed horizontal longitudinal edges of said first and second panel members.

76. The tie member defined in claim 75 wherein said first and second panel members each include at least one row of teeth and sockets positioned along each horizontal longitudinal edge, the teeth associated with one of the opposed horizontal longitudinal edges of said first and second panel members being vertically aligned with the sockets associated with the other of the opposed horizontal longitudinal edges, and the sockets associated with one of the opposed horizontal longitudinal edges of said first and second panel members being vertically aligned with the teeth associated with the other of the opposed horizontal longitudinal edges, at least some of said first and second interlocking members extending into a respective tooth associated with the opposed horizontal longitudinal edges of said first and second panel members.

77. A tie member for connecting first and second panel members in a spaced substantially parallel relationship, each of said panel members having a pair of horizontally opposed longitudinal edges, a pair of vertically opposed longitudinal edges, and inner and outer surfaces, said tie member comprising:

a pair of side wall bracket members, one of said side wall bracket members being mountable within one of said first and second said panel members and the other of said side wall bracket members being mountable within the other of said first and second panel members, each side wall bracket member including a fastening plate, a shut-off plate and a truss structure extending therebetween, said shut-off plates being positioned adjacent the inner surfaces of said first and second panel members, each shut-off plate including a plurality of spaced projections each having an opening extending therethrough, said plurality of projections extending into, the space formed between said first and second panel members;

a web member extending between said pair of side wall bracket members, the opposite end portions of said web member each including a complimentary plurality of spaced projections each having an opening extending respectively therethrough, the spaced projections of said web member being cooperatively engageable with the plurality of projections associated with said pair of shut-off plates so as to position the respective openings associated with said projections in alignment with each other;

a pin member engageable with the respective aligned openings of said plurality of projections for pivotally connecting the opposite end portions of said web member to the shut-off plates of said side wall bracket members, said pin member including a slotted end portion associated with each opposite end thereof, said slotted end portions being formed by flange portions which are arrowhead in shape;

each of said fastening plates including an extension portion associated with each opposite end thereof, each extension portion including an engaging member, the extension portions of one end of the fastening plates associated with one of said tie members being positionable in overlapping relationship with the extension portions of one end of the fastening plates associated with another one of said tie members and the engaging members associated with said extension portions mating with corresponding engaging members associated with another tie member when a pair of tie members are positioned in overlapping relationship to each other, at least some of said extension portions extending into the opposed horizontal longitudinal edges of said first and second panel members.

78. A tie member for connecting first and second panel members in a spaced substantially parallel relationship, each of said panel members having a pair of horizontally opposed longitudinal edges, a pair of vertically opposed longitudinal edges, and inner and outer surfaces, said tie member comprising:

a pair of side wall bracket members, one of said side wall bracket members being mountable within one of said first and second said panel members and the other of said side wall bracket members being mountable within the other of said first and second panel members, each side wall bracket member including a fastening plate, a shut-off plate and a truss structure extending therebetween, said shut-off plates being positioned adjacent the inner surfaces of said first and second panel members, each shut-off plate including a plurality of spaced projections each having an opening extending therethrough, said plurality of projections extending into, the space formed between said first and second panel members;

a web member extending between said pair of side wall bracket members, the opposite end portions of said web member each including a complimentary plurality of spaced projections each having an opening extending respectively therethrough, the spaced projections of said web member being cooperatively engageable with the plurality of projections associated with said pair of shut-off plates so as to position the respective openings associated with said projections in alignment with each other;

a pin member engageable with the respective aligned openings of said plurality of projections for pivotally connecting the opposite end portions of said web member to the shut-off plates of said side wall bracket members;

each of said fastening plates including an extension portion associated with each opposite end thereof, each extension portion including an engaging member, the extension portions of one end of the fastening plates associated with one of said tie members being positionable in overlapping relationship with the extension portions of one end of the fastening plates associated with another one of said tie members and the engaging members associated with said extension portions mating with corresponding engaging members associated with another tie member when a pair of tie members are positioned in overlapping relationship to each other, at least some of said extension portions extending into the opposed horizontal longitudinal edges of said first and second panel members; and an interlocking mechanism associated with each opposite end of each of said side wall bracket members, said interlocking mechanism being positioned and located between said fastening plate and said shut-off plate and including a pair of first and second interlocking members positioned adjacent to each other in a lateral offset arrangement, the first interlocking member of one end of each of the side wall bracket members being engageable with the second interlocking member of one end of each of the side wall bracket members associated with another one of said tie members, one of said first and second interlocking members including at least one projection and the other of said first and second interlocking members including at least one groove, the at least one projection of one of said first and second interlocking members associated with one end of each of the side wall bracket members being cooperatively engageable with the at least one groove of the other of said first and second interlocking members associated with one end of each of the side wall bracket members associated with another one of said tie members.

* * * * *